US011198299B2

(12) United States Patent
Leiser et al.

(10) Patent No.: US 11,198,299 B2
(45) Date of Patent: Dec. 14, 2021

(54) COLLAR FOR FLUID BARRIER

(71) Applicant: HEWLETT-PACKARD DEVELOPMENT COMPANY, L.P., Spring, TX (US)

(72) Inventors: Judson M. Leiser, Corvallis, OR (US); Michael E. Peterschmidt, Corvallis, OR (US); Milo A. Undlin, Corvallis, OR (US); Perrin Mao, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/764,907

(22) PCT Filed: Jul. 13, 2018

(86) PCT No.: PCT/US2018/042042
§ 371 (c)(1),
(2) Date: May 18, 2020

(87) PCT Pub. No.: WO2020/013858
PCT Pub. Date: Jan. 16, 2020

(65) Prior Publication Data

US 2020/0338897 A1 Oct. 29, 2020

(51) Int. Cl.
*B41J 2/175* (2006.01)

(52) U.S. Cl.
CPC ..... *B41J 2/17523* (2013.01); *B41J 2/17513* (2013.01); *B41J 2/17553* (2013.01); *B41J 2002/17516* (2013.01)

(58) Field of Classification Search
CPC ..... B41J 2/17523; B41J 2/17513; B41J 2/17553; B41J 2002/17516; B41J 2/1752
(Continued)

(56) References Cited

U.S. PATENT DOCUMENTS 4,421,146 A 12/1983 Bond
4,917,269 A 4/1990 Fuchs
(Continued)

FOREIGN PATENT DOCUMENTS

CN 1764402 4/2006
CN 101024343 8/2007
(Continued)

OTHER PUBLICATIONS

Plastic Kitchen Cabinet Adjustable Leg Clips (Dongguan Meizhong Plastic & Metal Products Co. Ltd), https://www.exportersindia.com/dongguan-meizhong-plastic-metal-products/plastic-kitchen-cabinet-adjustable-leg-clips-china-931438.htm.
(Continued)

*Primary Examiner* — Huan H Tran
*Assistant Examiner* — Alexander D Shenderov
(74) *Attorney, Agent, or Firm* — Fabian VanCott

(57) ABSTRACT

A fluid barrier may include a collar coupled to a first end of a fluidic channel of a fluidic interface wherein the collar comprises a lip to prevent separation of the fluidic channel from a pliable fluidic container. A printing fluid supply may include an at least partially collapsible fluid bag; and a substantially rigid fluidic interface having a fluidic channel fluidically coupled to the fluid bag and a collar coupled to the fluidic channel forming a fluid barrier between the fluid bag and the fluidic interface.

22 Claims, 18 Drawing Sheets

(58) Field of Classification Search
USPC ..... 347/85
See application file for complete search history.

(56) References Cited

U.S. PATENT DOCUMENTS

| | | | | |
|---|---|---|---|---|
| 4,938,510 | A | 7/1990 | Gmeiner | |
| 5,107,909 | A | 4/1992 | Donovan | |
| 5,299,718 | A | 4/1994 | Shwery | |
| 5,751,320 | A | 5/1998 | Scheffelin | |
| 6,010,210 | A | 1/2000 | Wilson | |
| 6,120,132 | A | 9/2000 | Coiner | |
| 7,287,843 | B2 | 10/2007 | Muranaka | |
| 7,334,889 | B2 | 2/2008 | Sasaki | |
| 7,429,101 | B2 | 9/2008 | Petersen | |
| 8,220,909 | B2 | 7/2012 | Domae | |
| 8,448,799 | B2 | 5/2013 | Thurman | |
| 8,474,655 | B2 | 7/2013 | Hackleman | |
| 8,479,785 | B2 | 7/2013 | Johnson | |
| 8,789,935 | B2 | 7/2014 | Murata | |
| 9,114,621 | B2 | 8/2015 | Shimizu | |
| 9,248,655 | B2 | 2/2016 | Nose | |
| 9,527,295 | B1 | 12/2016 | Tamarez | |
| 9,573,736 | B2 | 2/2017 | Arch | |
| 9,623,664 | B2 | 4/2017 | Maeshima | |
| 2002/0171713 | A1 | 11/2002 | Ueno | |
| 2004/0218021 | A1 | 11/2004 | Ishizawa | |
| 2004/0263569 | A1 | 12/2004 | Ros | |
| 2005/0184105 | A1 | 8/2005 | Johnson | |
| 2006/0038864 | A1* | 2/2006 | Konishi | B41J 2/17513 347/86 |
| 2006/0152561 | A1 | 7/2006 | Belfiore | |
| 2009/0096836 | A1 | 4/2009 | Haines | |
| 2012/0162326 | A1 | 6/2012 | Kobayashi | |
| 2012/0162329 | A1 | 6/2012 | Mizuno | |
| 2013/0215201 | A1 | 8/2013 | Murata | |
| 2014/0332492 | A1* | 11/2014 | Seki | B65D 75/5883 215/247 |
| 2014/0353364 | A1 | 12/2014 | Coogan | |
| 2015/0028065 | A1 | 1/2015 | Arch | |
| 2015/0232264 | A1 | 8/2015 | Pansegrouw | |
| 2015/0290945 | A1 | 10/2015 | Naito | |
| 2016/0303863 | A1 | 10/2016 | Sakai | |
| 2017/0081060 | A1 | 3/2017 | Meijden | |
| 2018/0043695 | A1 | 2/2018 | Kawate | |

FOREIGN PATENT DOCUMENTS

| | | | |
|---|---|---|---|
| CN | 101189173 | | 5/2008 |
| CN | 101254708 | | 9/2008 |
| CN | 102026889 | | 4/2011 |
| CN | 103459268 | | 12/2013 |
| CN | 203322492 | U | 12/2013 |
| CN | 204566929 | | 8/2015 |
| CN | 105383167 | | 3/2016 |
| DE | 102006054113 | B3 | 1/2008 |
| EP | 0516088 | | 12/1992 |
| EP | 0854045 | A2 | 7/1998 |
| EP | 1201437 | A1 | 5/2002 |
| EP | 1504908 | A2 | 2/2005 |
| EP | 1817241 | A2 | 8/2007 |
| EP | 2783861 | A2 | 10/2014 |
| JP | 04347653 | | 12/1992 |
| JP | 05162333 | | 6/1993 |
| JP | H10157770 | A | 6/1998 |
| JP | 2002019136 | A | 1/2002 |
| JP | 2004189276 | A | 7/2004 |
| JP | 2009298444 | | 12/2009 |
| JP | 2010158906 | | 7/2010 |
| JP | 4973758 | B2 | 7/2012 |
| JP | 5513420 | B2 | 8/2012 |
| JP | 2012158343 | | 8/2012 |
| JP | 5200677 | B2 | 6/2013 |
| JP | 2017164955 | A | 9/2017 |
| KR | 20160002716 | | 8/2016 |
| WO | WO-9742035 | | 11/1997 |
| WO | WO-2006019034 | A1 | 2/2006 |
| WO | WO-2009139761 | A1 | 11/2009 |
| WO | WO-2017014779 | A1 | 1/2017 |
| WO | WO-2017213162 | A1 | 12/2017 |

OTHER PUBLICATIONS

Type 2 Button-fix (Button-fix), <http://button-fix.com/button-fix-type-2-fix/>.
Ultima Pod Box Brackets (Ultima), <https://www.comtecdirect.co.uk/product/ultima-pod-box-brackets/PG0149/778434>.

* cited by examiner

COLLAR FOR FLUID BARRIER

BACKGROUND

Printing devices operate to dispense a liquid onto a surface of a substrate. In some examples, these printing devices may include two-dimensional (2D) and three-dimensional (3D) printing devices. In the context of a 2D printing device, a liquid such as an ink may be deposited onto the surface of the substrate. In the context of a 3D printing device, an additive manufacturing liquid may be dispensed onto the surface of the substrate in order to build up a 3D object during an additive manufacturing process. In these examples, the print liquid is supplied to such printing devices from a reservoir or other supply. The print liquid reservoir holds a volume of print liquid that is passed to a liquid deposition device and ultimately deposited on a surface.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
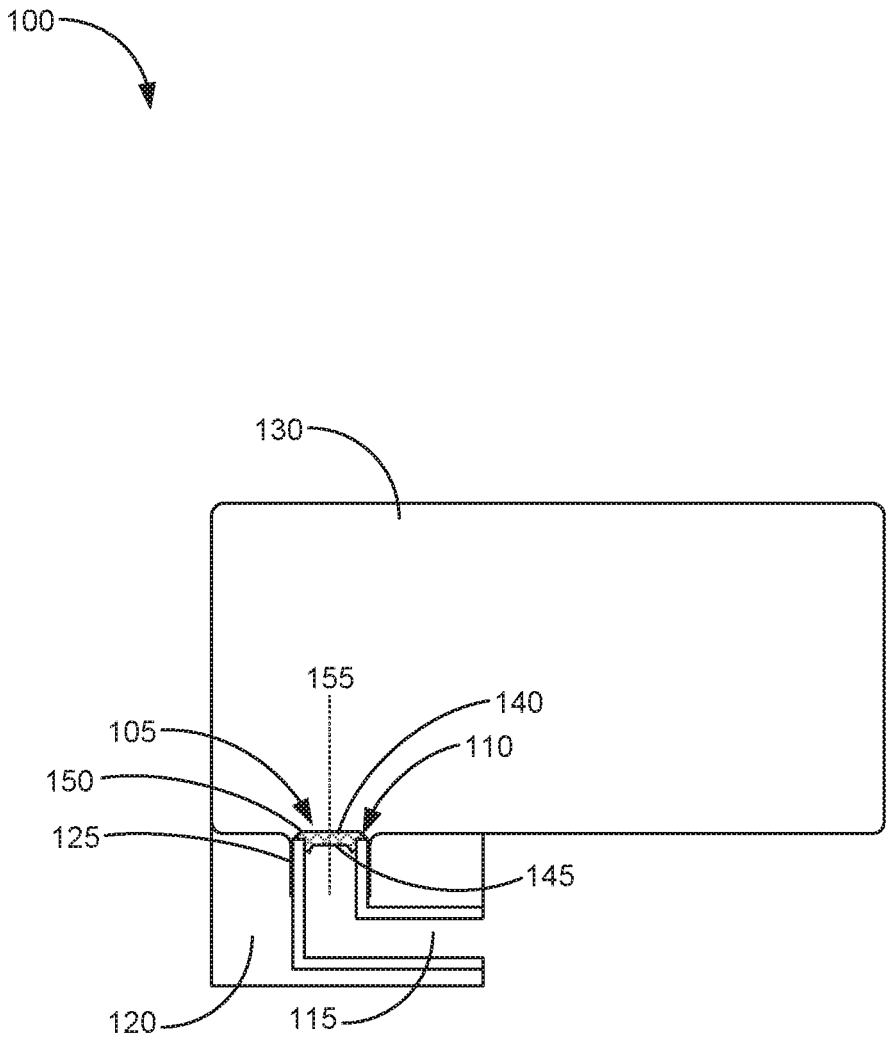
FIG. 1 is a side diagrammatic view of a fluid barrier according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Fluids such as printing fluids in a printing device and/or an additive manufacturing liquid in 3D printing devices are supplied to a deposition device from liquid supplies. Such liquid supplies come in many forms. For example, one such liquid supply is a pliable reservoir. Pliable reservoirs are simple in the manner in which they are made as well as their low cost. However, pliable reservoirs themselves are difficult to handle and couple to an ejection device. For example, it may be difficult for a user to physically manipulate a pliable reservoir into place within a printing device due to a lack of rigid structure around the pliable reservoir.

In examples described herein, the pliable reservoirs are disposed within a container, carton, box, or other similar structure. The container provides a structure that is relatively easier to be handled by a user. That is, a user can more easily handle a rigid container than a pliable reservoir alone. As a specific example, over the course of time, the liquid in a liquid supply is depleted such that the liquid supply is to be replaced by a new supply. Accordingly, ease of handling makes the replacement of liquid supplies ore facile and leads to a more satisfactory consumer experience. Pliable containment reservoirs disposed within a rigid container may be, in some examples, referred to as bag-in-box supplies or bag-in-box liquid supplies. Such bag-in-box supplies thus provide easy handling along with simple and cost-effective manufacturing.

While the bag-in-box supplies provide certain characteristics that may further increase their utility and efficacy, in order to impart proper functionality of a printing device, a fluid-tight path is to be established between the reservoir and the printing device. To establish such a path, alignment between the reservoir and the ejection device components that receive the liquid from the reservoir may be formed. Due to the flimsy nature of pliable reservoirs, it may be difficult to ensure a proper alignment between the reservoir and the ejection device.

Accordingly, the present specification describes a print liquid reservoir and bag-in-box print liquid supply that creates a structurally rigid interface between a spout of the containment reservoir and an ejection system. That is, the present system locates, and secures, a spout of the reservoir in a predetermined location. Being thus secured, the spout through which print liquid passes from the containment reservoir to the ejection device should not rotate, flex or translate relative to the rigid container, but will remain stationary relative to the container. Affixing the spout in this fashion ensures that the spout will remain solid through installation and use.

In any of the examples presented herein, a fluid barrier may include a collar coupled to a first end of a fluidic channel of a fluidic interface. In any example presented herein, the collar comprising a lip to prevent separation of the fluidic channel from a pliable fluidic container. In any of the examples presented herein, the collar may be placed on the first end of the fluidic channel securing the fluidic interface with a pliable fluidic container. In any of the examples presented herein, the collar may be coupled to the first end of the fluidic channel via laser beam welding. In any of the examples presented herein, the collar may include a flash trap formed between the collar and the first end of the fluidic channel to receive an amount of melted weld material therein during a laser beam welding process.

In any of the examples presented herein, the collar includes a bottom surface, the bottom surface interfacing with a top surface of the fluidic channel. In any of the examples presented herein, the bottom surface may include a barrel extending from the bottom surface, an exterior surface of the barrel interfacing with an interior surface of the fluidic channel. In any of the examples presented herein, the bottom surface may include a lip extending past the first end of the fluidic channel. In any of the examples presented herein, wherein the collar includes a top surface, the top surface having a radially tapered surface tapered from the top surface of the collar toward the first end of the fluidic channel. In any of the examples presented herein, the angle of the radially tapered surface is 18-25 degrees relative to an axis of the collar. In any of the examples presented herein, the collar includes at least one structurally supporting spoke formed between interior surfaces of the collar. In any of the examples presented herein, the collar may include an annularly concave portion to receive a gasket interior to the fluidic channel.

The present specification further describes a printing fluid supply. In any of the examples presented herein, the printing fluid supply may include an at least partially collapsible fluid bag. In any of the examples presented herein, the printing fluid supply may include a substantially rigid fluidic interface having a fluidic channel fluidically coupled to the fluidic bag. In any of the examples presented herein, the printing fluid supply may include a collar coupled to the fluidic channel forming a fluid barrier between the fluidic bag and the fluidic interface.

In any of the examples presented herein, the fluidic interface includes a needle receiving liquid channel portion with a liquid interface to interface with a receiving station needle and a bag connecting liquid channel portion that extends at an angle with the needle receiving liquid channel portion, wherein the bag connecting liquid channel portion projects from the fluidic interface to connect to the bag inside a support container that holds the bag. In any of the examples presented herein, the collar is more fluid permeable relative to the fluid bag. In any of the examples presented herein, the collar is more fluid permeable relative to the fluidic interface.

In any of the examples presented herein, the collar further comprises a flash trap formed between the collar and a first end of the fluidic channel to receive an amount of melted weld material therein during a laser beam welding process welding the collar to the fluidic channel. In any of the examples presented herein, a first surface of the collar may include a radially tapered surface tapered from the first surface of the collar toward a second surface of the collar opposite the first surface of the collar. In any of the examples presented herein, the angle of the radially tapered surface is 18 to 25 degrees relative to an axis of the collar.

The present specification further describes a bag-in-box printing fluid supply. In any of the examples presented herein, the bag-in-box printing fluid supply may include a pliable fluid containment bag to hold a supply of printing fluid. In any of the examples presented herein, the bag-in-box printing fluid supply may include a carton in which the pliable fluid containment bag is disposed. In any of the examples presented herein, the bag-in-box printing fluid supply may include a fluidic channel formed in a fluidic interface fluidically coupled to the pliable fluid containment bag. In any of the examples presented herein, the bag-in-box printing fluid supply may include a collar coupled to an end of the fluidic channel, the fluidic channel and collar placed within a spout of the pliable fluid containment bag.

In any of the examples presented herein, the spout may include at least one rib formed on an interior surface of the spout wherein the ribs provide an interference fit with a portion of the fluidic channel. In any of the examples presented herein, the collar may include a first surface, the collar including a radially tapered surface tapered from the first surface of the collar toward a second surface of the collar opposite the first surface of the collar. In any of the examples presented herein, the angle of the radially tapered surface is 18 to 25 degrees relative to an axis of the collar. In any of the examples presented herein, the radially tapered surface prevents damage to the ribs of the fluidic channel during an insertion process of the collar and fluidic channel into the spout of the pliable fluid containment bag.

As used in the present specification and in the appended claims, the term "print liquid supply" refers to a device that holds a print fluid. For example, the print liquid supply may be a pliable reservoir. Accordingly, a print liquid supply container refers to a carton or other housing for the print liquid supply. For example, the print liquid supply container may be a cardboard box in which the pliable containment reservoir is disposed.

Still further, as used in the present specification and in the appended claims, the term "print fluid" refers to any type of fluid deposited by a printing device and can include, for example, printing ink or an additive manufacturing fabrication agent, Still further, as used in the present specification and in the appended claims, the term "fabrication agent" refers to any number of agents that are deposited and includes for example a fusing agent, an inhibitor agent, a binding agent, a coloring agent, and/or a material delivery agent. A material delivery agent refers to a liquid carrier that includes suspended particles of at least one material used in the additive manufacturing process.

Turning to the figures, FIG. 1 is a side diagrammatic view of a fluid barrier (100) according to an example of the principles described herein. The fluid barrier (100) may include any type of device or types of devices that either alone or in combination prevents the transfer of a fluid into or out of a pliable fluidic container (130). In an example, the fluid barrier (100) may include a collar (105). In some examples, the collar (105) may be used at a location within the fluid barrier (100) where, for example, impermeable fluid barriers are not present. In the example of FIG. 1, the collar (105) is placed between the pliable fluidic container (130) and a fluidic channel (115) of a fluidic interface (120). In a specific example, the collar (105) may be coupled to a first end of the fluidic channel (115) of the fluidic interface (120) with a portion of the fluidic channel (115) and the collar (105) being placed within a spout (125) of the pliable fluidic container (130).

The pliable fluidic container (130) may serve as a reservoir to hold an amount of liquid such as a printing liquid. In order to prevent fluid transfer (gases and/or fluids) out of and/or into the body of the pliable fluidic container (130) except through the spout (125), the pliable fluidic container (130) may be made of a plurality of layers of material. In any of the examples presented herein, the pliable fluidic container (130) may be formed out of a plastic film, a metallic film, or a combination thereof to inhibit air/vapor transfer. In any of the examples presented herein, the multiple layers of material may each have differing properties so as to prevent such transfer of fluids through the body of the pliable fluidic container (130). In some examples, the bag (130) may be gas impermeable as well to prevent gases from entering the bag (130) and mixing with the contents therein. In any example presented herein, the bag may be any collapsible liquid holding reservoir.

The pliable fluidic container (130) may include a spout (125) to direct the liquid stored therein to the fluidic interface (120) as described herein. The spout (125), in any examples presented herein, may be made of a different material that is relatively more resilient to deformation than that used to form the pliable fluidic container (130). In an example, the spout (125) is made out of a polymeric material such as polyethylene. However, the material the spout (125) is made of may not have the same fluid impermeability characteristics that the material used to form the fluid barrier (100). As such, additional components such as the collar (105) and/or fluidic channel (115) may be used to maintain the fluidic barrier between the atmosphere and the fluid maintained within the pliable fluidic container (130).

In any of the examples presented herein, the collar (105) may be made of any type of material. In any of the examples presented herein, the collar (105) may be made of a polymeric material such as polypropylene, polyester, polyethylene terephthalate (PET), and copolyethylene terephthalate (coPET). In any of the examples presented herein, the material used to form the collar (105) may be made of a hard material relative to the material the spout (125) is made of. In an example, the fluidic channel (115) and collar (105), when assembled, are fluidically coupled to the pliable fluidic container (130) via the spout (125) by forcing the collar (105) and fluidic channel (115) into the spout (125). By forcing the collar (105) and fluidic channel (115) through the spout (125), damage may occur to the interior of the spout (125) when the material used to form the collar (105) is relatively harder than, in an example, the polyethylene that the spout (125) is made of. Specifically, damage to the interior surface of the spout (125) may result in a compromised fluidic seal at the interface between the collar (105) and spout (125) thereby facilitating fluid permeability into and out of the pliable fluidic container (130).

As described, the interface between the collar (105)/fluidic channel (115) subassembly and the spout (125) may serve as a fluid impermeable interface within the fluid barrier (100). In order to provide this fluid impermeable interface, the spout (125) may include a number of ribs formed on an interior surface of the spout (125). The ribs may include any type of raised portion of the surface of the interior surface of the spout (125) that reduces the interior diameter of the spout (125). In some examples, the ribs may include raised rings formed on the interior surface of the spout (125). During assembly of the collar (105)/fluidic channel (115) subassembly to the spout (125), the collar (105)/fluidic channel (115) subassembly may be shoved into the spout (125) and past the ribs. The ribs allow for an interference fit between the collar (105)/fluidic channel (115) subassembly and the spout (125) thereby creating a fluid impermeable barrier within the fluid barrier (100).

The fluidic channel (115) may be any type of channel formed with the fluidic interface (120). Although FIG. 1 shows that the fluidic channel (115) includes a single channel, the present specification contemplates that any number of fluidic channels may be formed within the fluidic interface (120) such that a fluid from the pliable fluidic container (130) can be transported through the fluidic interface (120) and to a printing device.

The collar (105) may include a first surface (140) and a second surface (145). The first surface (140) may be exposed within the pliable fluidic container (130) and the second surface (145) may be exposed within the fluidic channel (115). The first surface (140) of the collar (105) may include a radially tapered surface (150) tapered from the first surface (140) of the collar (105) toward the fluidic channel (115) and the second surface (145) of the collar (105). The angle of the tapered surface (150) may be between 18-25 degrees relative to an axis (155) of the collar (105). The tapered surface (150) may be selected so as to prevent damage to the interior surface of the spout (125) when the collar (105)/fluidic channel (115) subassembly is pressed into the spout (125) during assembly.

The second surface (145) of the collar (105) may interface with a first surface of the fluidic channel (115). In an example, the collar (105) may be coupled to the first end of the fluidic channel (115) via a laser beam welding process. In this example, the angle of the tapered surface (150) may allow a laser beam to enter through the first surface (140) of the collar (105) and heat interfacing surfaces between the collar (105) and the first end of the fluidic channel (115). In this example, the collar (105) may be optically transparent or optically semi-transparent to allow the laser beam to pass through the collar (105). During the laser welding process, some portion of the collar (105) and/or first end of the fluidic channel (115) may be melted. These melted portions may flow out of the interface between the collar (105) and the fluidic channel (115). If left, the melted portions of the collar (105) and/or first end of the fluidic channel (115) may subsequently harden so as to create bulges and/or sharp protrusions out of the collar (105)/fluidic channel (115) subassembly. The bulges and/or sharp protrusions may damage the interior surface of the spout (125) leading to an incomplete fluid barrier (100). To prevent the formation of the bulges and/or sharp protrusions, the collar (105) may include a flash trap formed between the collar (105) and the first end of the fluidic channel (115). The flash trap may receive an amount of the melted material from the collar (105) and/or first end of the fluidic channel (115) therein during the laser beam welding process.

The second surface (145) may further include a barrel extending from the second surface. The barrel may be formed may include an exterior surface that interfaces with an interior surface of the fluidic channel (115). In any of the examples presented herein, the barrel may include a dipped surface to interface with a gasket placed within the fluidic channel (115). In any of the examples presented herein, the second surface (145) may further include a lip extending past the first end of the fluidic channel (115). During assembly of the collar (105)/fluidic channel (115) subassembly with the spout (125) of the pliable fluidic container (130), the lip may prevent disassembly of the collar (105)/fluidic channel (115) subassembly from the spout (125).

In any of the examples presented herein, the collar (105) may include a structurally supporting spoke. The structurally supporting spoke may be formed between interior surfaces of a via formed along the axis (155) of the collar (105). Any number of structurally supporting spokes may be formed between interior surfaces of the collar (105).

Figure 2:
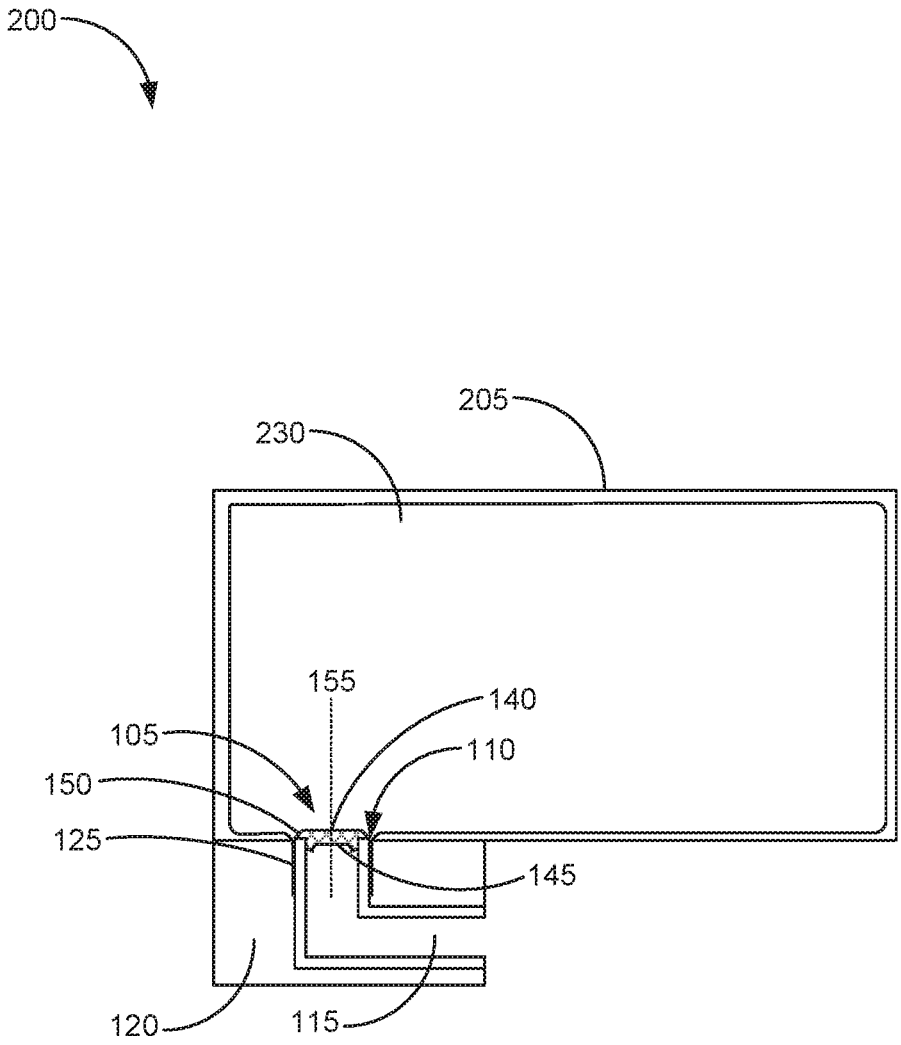
FIG. 2 is a side diagrammatic view of a printing fluid supply according to an example of the principles described herein.

FIG. 2 is a side diagrammatic view of a printing fluid supply (200) according to an example of the principles described herein. The printing fluid supply (200) may include, in any of the examples presented herein, a collar (105). The collar (105) may help to form an impermeable fluid barrier between a fluid maintained in a pliable fluid containment bag (230) similar to the pliable fluidic container (FIG. 1, 130) shown in FIG. 1. In any of the examples presented herein, the printing fluid supply (200) may include a carton (205) that holds the pliable fluid containment bag (230) therein as described herein. In any of the examples presented herein, a surface of the carton (205) may be sandwiched between a fluidic interface (120) and a portion of the pliable fluid containment bag (230) using a wedge plate. The wedge plate may provide structural support to the carton (205) and fluidic interface (120) as described herein.

In any of the examples described herein, the carton (205) may include a number of walls that form a cuboid shape. In any of the examples described herein, the carton (205) may be made of a material that imparts structural support to the bag (230) to be maintained therein. Examples of materials that may be used to form the carton (205) may include a fiberboard material. In an example, the carton (205) may be made of a corrugated fiberboard material. In an example, the corrugated fiberboard material may be an f-fluted corrugated fiberboard material. Although, the present specification describes the carton (205) as being made of a corrugated fiberboard material, the present specification contemplates that the material used to form the carton (205) may include other fiberboards such as an uncorrugated fiberboard, a polymer, a metal, a plastic or other material. In an example, the carton (205) may be formed from a single sheet of fiberboard material. In this example, the fiberboard material may be shaped by creating creases therein that produce fold locations. The carton (205), in this example, may then be folded such that the six walls of the cuboid shape may be formed. In an example, the carton (205) may include a number of flaps that overlap at least one wall. The flap may be secured to a wall via an adhesive material.

Figure 3:
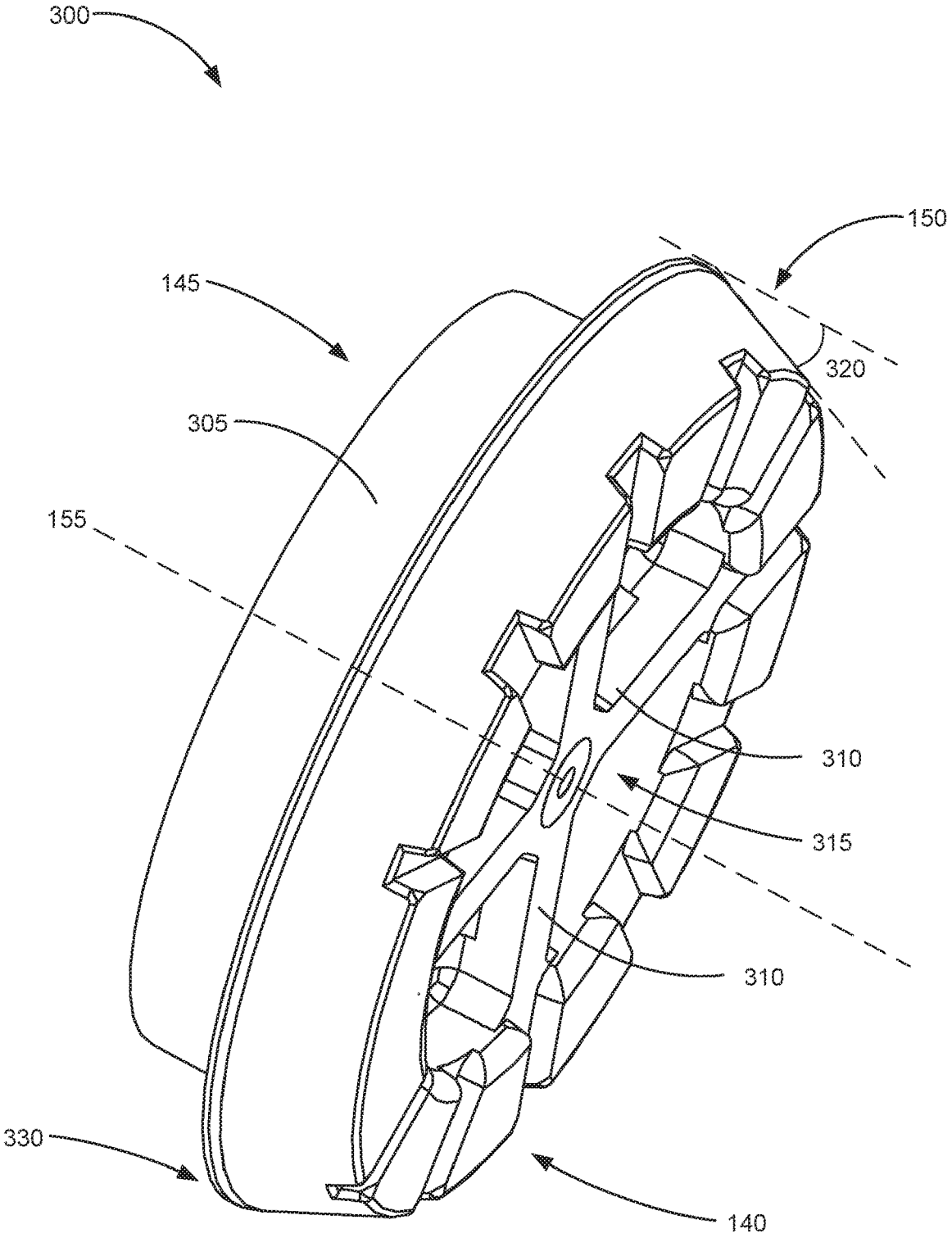
FIG. 3 is an isometric view of a collar (300) according to an example of the principles described herein.

FIG. 3 is an isometric view of a collar (300) according to an example of the principles described herein. The collar (300), in FIG. 3, is shown separate from the fluidic channel (FIG. 1, 115) and pliable fluidic container (FIG. 1, 130) described herein. The collar (300) includes a barrel (305) that fits within the fluidic channel (FIG. 1, 115) with an exterior surface of the barrel (305) abutting an interior surface of the fluidic channel (FIG. 1, 115) when coupled together. As described herein, the collar (300) may, in any of the examples presented herein, include a structurally supporting spoke (310) that structurally supports a passageway (315) formed through the collar (300).

The collar (300) may, in any of the examples presented herein, include a tapered surface (150). The tapered surface (150) may include an angle (320) the tapers from the first surface (140) out to the first surface (140) of the collar (300). The angle (320) may be between 18-25 degrees relative to an axis (155) of the collar (300). In any of the examples presented herein, the tapered surface (FIG. 1, 150) may help to prevent damage to an interior surface of a spout (FIG. 1, 125) of a pliable fluidic container (130) when the collar (300) is pressed fit through the spout (FIG. 1, 125).

In any of the examples presented herein, the circumference of the collar (105) may be larger relative to an exterior circumference of the fluidic channel (115). In this example, a lip (330) may be formed that extends past an exterior radius of the fluidic channel (FIG. 1, 115). The lip (330) may prevent the collar (300)/fluidic channel (FIG. 1, 115) subassembly from being removed from inside the spout (FIG. 1, 125) when pressed fit into the spout (FIG. 1, 125).

Figure 4:
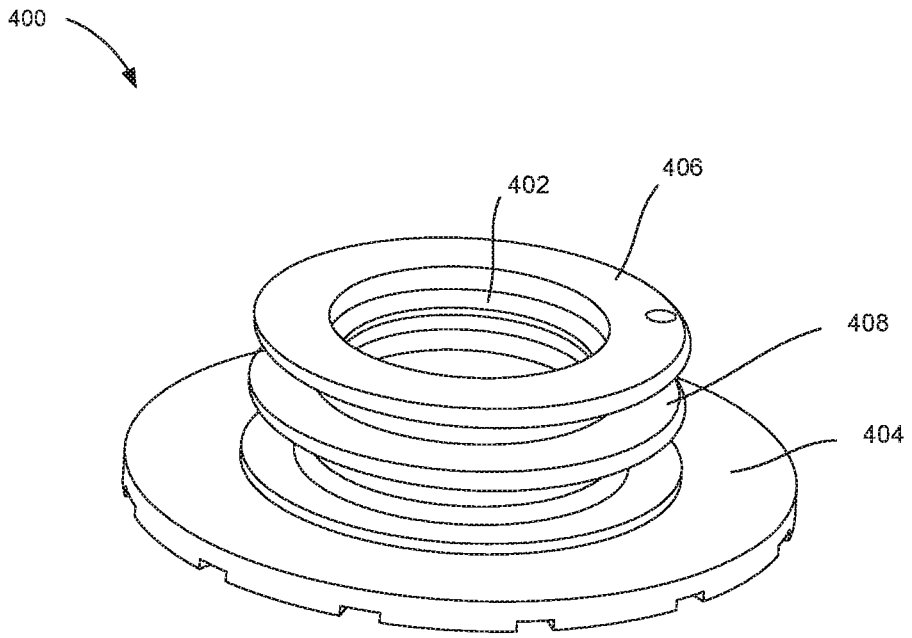
FIG. 4 is an isometric view of a spout with an angled clamp flange for a print liquid supply according to an example of the principles described herein.

FIG. 4 is an isometric view of a spout (400) with an angled clamp flange (408) for a print liquid supply, according to an example of the principles described herein. The spout (400) enables print liquid disposed within a reservoir such as the pliable fluidic container (FIG. 1, 130) to be passed to an ejection device for deposition on a surface. The spout (400) may be formed of any material such as a polymeric material. In a specific example, the spout (400) is formed of polyethylene.

The spout (400) includes various features to ensure accurate and effective liquid transportation. Specifically, the spout (400) includes a sleeve (402) having an opening through which the print liquid passes. The sleeve (402) is sized to couple with a component of a liquid ejection device. For example, the sleeve (402) may be coupled to a receiver port within a printing device. Once coupled, liquid within the reservoir is drawn/passes through the sleeve (402) to the ejection device. That is, during operation forces within the ejection device draw liquid from the reservoir, through the sleeve (402) and into the ejection device. The ejection device then operates to expel the liquid onto a surface in a desired pattern.

The sleeve (402) may be cylindrical and formed of a rigid material, such as a rigid plastic, to facilitate secure coupling to the receiver port. The sleeve (402) may have an inside diameter of between 5 millimeters to 20 millimeters. For example, the sleeve (402) may have an inside diameter of between 10 millimeters and 15 millimeters. As a further example, the sleeve (402) may have an inside diameter of between 11.5 millimeters and 12.5 millimeters.

The spout (400) also includes a first flange (404). The first flange (404) extends outward from the sleeve (402) and affixes the spout (400) to the reservoir. For example, the reservoir may, in an empty state, include a front face and a back face. The front face may have a hole that is sized to allow a second flange (406) and the angled clamp flange (408) to pass through, but not the first flange (404). That is, the first flange (404) may have a diameter that is greater than a diameter of both the angled clamp flange (408) and the second flange (406).

Accordingly, in use, the first flange (404) may be disposed on one side, an interior side, of the front face and the second flange (406) and the angled clamp flange (408) may be disposed on the other side, an exterior side, of the front face. Heat and/or pressure may then be applied to the spout (400) and reservoir such that the first flange (404) material composition and/or the reservoir material composition alters such that the spout (400) and reservoir are permanently affixed to one another. In this fashion, the first flange (402) affixes the spout (400) to the reservoir.

The spout (400) also includes a second flange (406). The second flange (406) similarly extends outward from the sleeve (402). The second flange (406) affixes the spout (400) and corresponding reservoir to the container or box in which they are disposed. That is, during use, it is desirable that the spout (400) remains in one position and not move from that position. Were the spout (400) to move, this might affect the liquid delivery. For example, if the spout (400) were to translate, it may not line up with the interface on an ejection device such that liquid would not be delivered as desired to the ejection device or may not be delivered at all. Moreover, such a misalignment could result in liquid leak and/or damage to components of the ejection device or the liquid supply. Accordingly, the second flange (406), along with the angled clamp flange (408) operate to locate the spout (400) in a predetermined position without movement relative to a container.

Figure 16A:
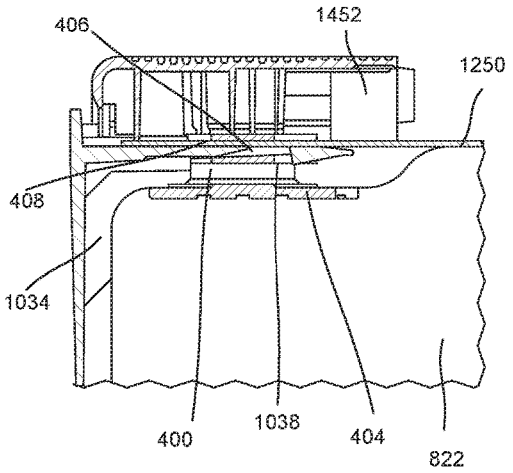
FIGS. 16A and 16B illustrate a cross-sectional view and isometric view, respectively of the assembly of a print liquid supply according to an example of the principles described herein.
Figure 16B:
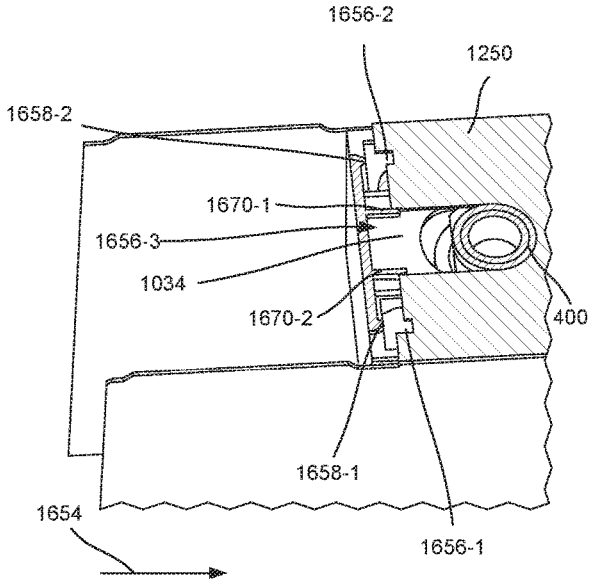

More specifically, when installed, the second flange (406) sits on a wall of the container or box in which the reservoir is disposed, A clamp plate and a surface of the print liquid supply container are disposed and squeezed, between the second flange (406) and the angled clamp flange (408). The force between the second flange (406) and the container secures the spout (400) in place relative to the container. As the container is rigid, the spout (400) therefore is rigidly located as well. FIGS. 16A and 16B depict the installation and location of the spout (400).

Figure 5:
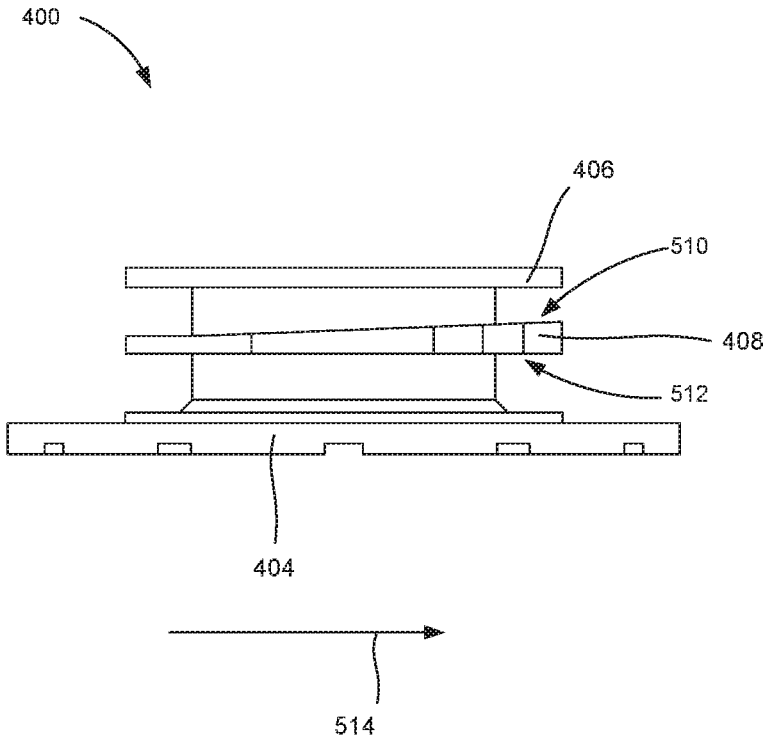
FIG. 5 is a side view of the spout with an angled clamp flange for a print liquid supply according to an example of the principles described herein.

The spout (400) also includes an angled clamp flange (408). As described above, the angled clamp flange (408), along with the second flange (406) securely affix the spout (402), and the reservoir to which it is attached, to the container such that it does not move relative to the container. Any relative movement between the container and the spout (402) may compromise the liquid path between the reservoir and the ejection device thus resulting in ineffective liquid delivery, liquid leaks, and/or component damage. FIG. 5 further depicts the operation of the angled clamp flange (408).

Figure 8:
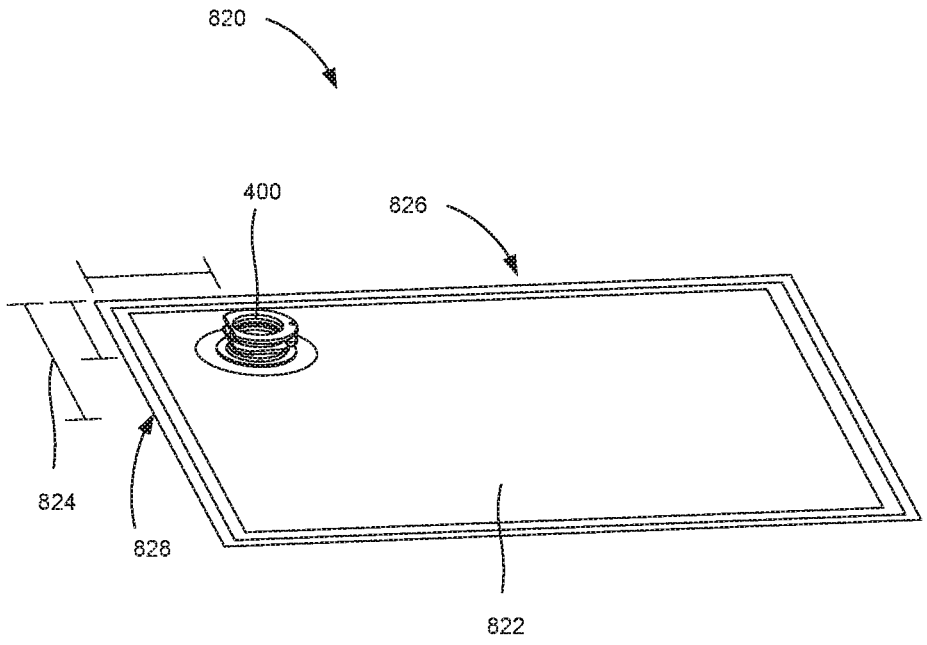
FIG. 8 is an isometric view of a pliable print liquid supply reservoir with an offset spout according to an example of the principles described herein.

Specifically, FIG. 5 is a side view of the spout (400) with the angled clamp flange (408) for a print liquid supply depicted in FIG. 8 herein according to an example of the principles described herein. As depicted in FIG. 5, the angled clamp flange (408) has 1) an angled surface (510) and 2) a straight surface (512) that is opposite the angled surface (510). While FIG. 5 depicts element (512) as a surface parallel to the first flange (404) and the second flange (406), in some examples, element (512) may be parallel with the angled surface (510), In yet more examples, element (512) may be non-parallel to the first flange (404), the second flange (406), and/or the angled surface (510).

In some examples, the angled surface (510) has an angle of between 0.5 and 10 degrees relative to the straight surface (512). More specifically, the angled surface (510) has an angle between 0.5 and 8 degrees relative to the straight surface (512). In yet another example, the angled surface (510) has an angle between 0.5 and 3 degrees relative to the straight surface. The angled clamp flange (408) width increases along an insertion direction, which insertion direction is indicated in FIG. 5 by the arrow (514). The angled surface (510) increasing along the insertion direction facilitates the clamping or affixing of the spout to a predetermined location relative to the container. Specifically, as described above, the second flange (406) is to sit on top of a wall of the container. Then a clamp plate is slid along the angled clamp flange (408), and the clamp plate and external surface of the container are compressed between the angled clamp flange (408) and the second flange (406). This compression provides a force that affixes the spout (400) and the associated reservoir to the container.

Accordingly, the spout (400) as described herein is held firmly in place in a position relative to the container, such that the container and the reservoir move as one. Being so disposed, a user can manipulate the container knowing that the spout (400) will remain in that particular position, thus allowing alignment of the spout (400) with a liquid delivery system of the ejection device. Were the spout (400) not held firmly in place, movement of the spout (400) during insertion of the container into the printing device may occur, with such movement affecting the ability to establish a proper fluidic connection between the reservoir and the ejection device. In other words, the spout as described herein allows for the use of a pliable reservoir which can hold large quantities of fluid, is easily manufacturable, and is impermeable to liquid and air transfer, all while being simple to insert into an ejection device.

Figure 6:
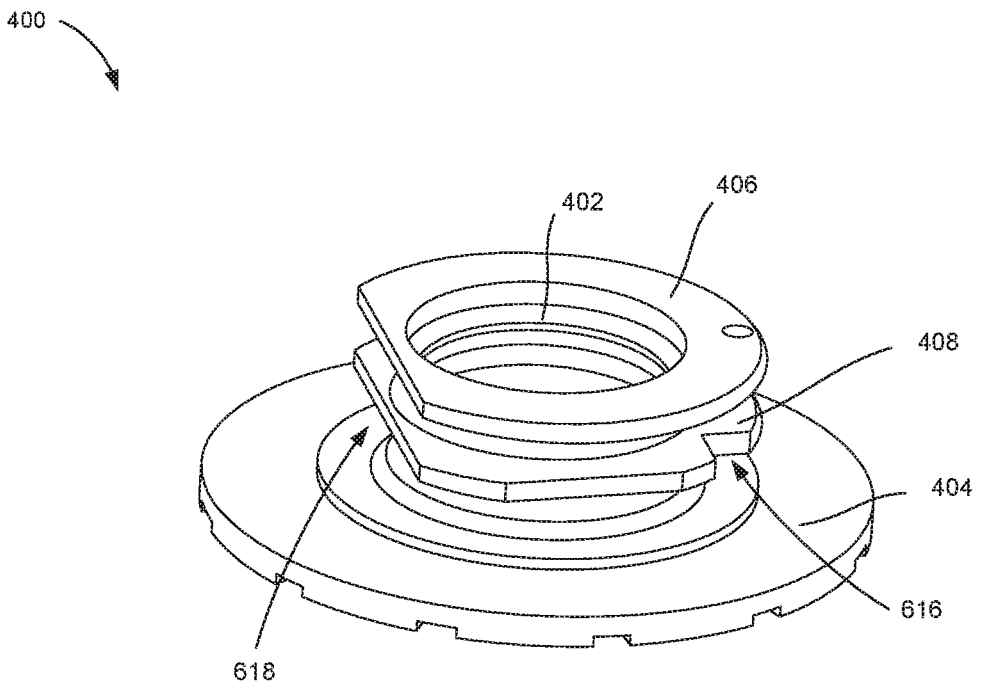
FIG. 6 is an isometric view of a spout with an angled clamp flange for a print liquid supply according to another example of the principles described herein.

In some examples, additional features of the spout (400) may be present. Accordingly, FIG. 6 is an isometric view of a spout (400) with an angled clamp flange (408) for a print liquid supply according to another example of the principles described herein. Specifically, in this example, in addition to the sleeve (402), first flange (404), second flange (406), and angled clamp flange (408), this spout (400) includes at least one notch (616) in the angled clamp flange (408). The at least one notch (616) receives protrusions on the clamp plate and allows the clamp plate to rotate parallel with the second flange (406). That is, the clamp plate may initially be rotated relative to the spout (400) to allow the container to be positioned underneath the second flange (406). Such rotation allows for a large opening for the external surface to be inserted into. That is, if the clamp plate were initially parallel to the second flange (406), there would be little space to insert the container wall, thus impacting the ease of assembly.

Once the sleeve (402) is properly aligned with the wall of the container, protrusions on the clamp plate fit into the notches (616) such that the clamp plate rotates to be parallel to, and adjacent with, the container. Following rotation, the angle of the angled clamp flange (408) forces a sliding clamp plate to compress the container wall against the second flange (406) thus providing the force to retain the spout (400) in place relative to the container. A specific example of the operation of the spout (400) and the clamp plate is provided in connection with FIGS. 16A and 16B.

Figure 7:
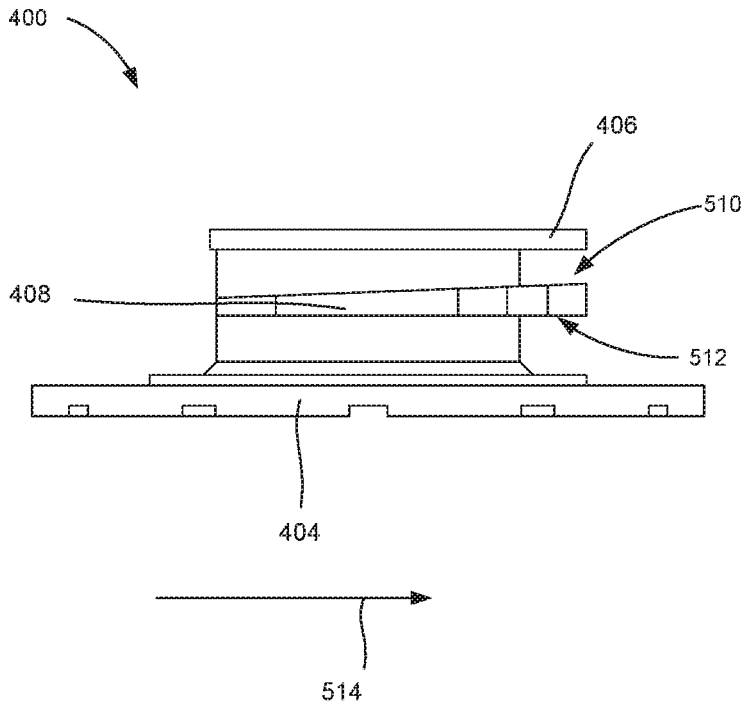
FIG. 7 is a side view of a spout with an angled clamp flange for a print liquid supply depicted in FIG. 4 according to an example of the principles described herein.

FIG. 7 is a side view of a spout (400) with an angled clamp flange (408) for a print liquid supply depicted in FIG. 6 according to an example of the principles described herein. In some examples, the spout (400) also includes an alignment mechanism to align the spout (400) to a predetermined radial position relative to the print liquid supply. That is, as mentioned above, the angled clamp flange (408) may increase in width along an insertion direction (514). Accordingly, the alignment mechanism may ensure that the spout (400) is aligned such that the angled clamp flange (408) increases in width along this insertion direction. That is, the alignment mechanism may ensure that the spout (400) is inserted into the reservoir such that the angled clamp flange (408) is aligned such that a thickest part of the angled clamp flange (408) is further along an insertion direction (514) than a thinner part of the angled clamp flange. Put yet another way, the alignment mechanism ensures that the spout (400) is aligned such that, upon insertion, the clamp plate first interacts with a thin part of the angled clamp flange (408) and later interacts with the thick part of the angled clamp flange (408).

In the specific example depicted in FIGS. 6 and 7, the alignment mechanism is a cutout (618) of at least one of the angled clamp flange (408) and the second flange (406). During insertion of the spout (400) into the reservoir, this cutout (618) may be aligned with a datum surface to ensure a proper alignment.

FIG. 8 is an isometric view of a print liquid supply (820) that includes a spout (400) with an angled clamp flange (408), according to an example of the principles described herein. The print liquid supply (820) includes a pliable reservoir (822). In some examples, the reservoir (822) may be a collapsible reservoir (822). That is, the reservoir (822) may form to the contents disposed therein.

As described above, the reservoir (822) holds any type of liquid such as ink to be deposited on a 2D substrate or an additive manufacturing fabrication agent to be disposed on a 3D build material. For example, in an additive manufacturing process, a layer of build material may be formed in a build area. A fusing agent may be selectively distributed on the layer of build material in a pattern of a layer of a three-dimensional object. An energy source may temporarily apply energy to the layer of build material. The energy can be absorbed selectively into patterned areas formed by the fusing agent and blank areas that have no fusing agent, which leads to the components to selectively fuse together.

Additional layers may be formed and the operations described above may be performed for each layer to thereby generate a three-dimensional object. Sequentially layering and fusing portions of layers of build material on top of previous layers may facilitate generation of the three-dimensional object. The layer-by-layer formation of a three-dimensional object may be referred to as a layer-wise additive manufacturing process.

Figure 9:
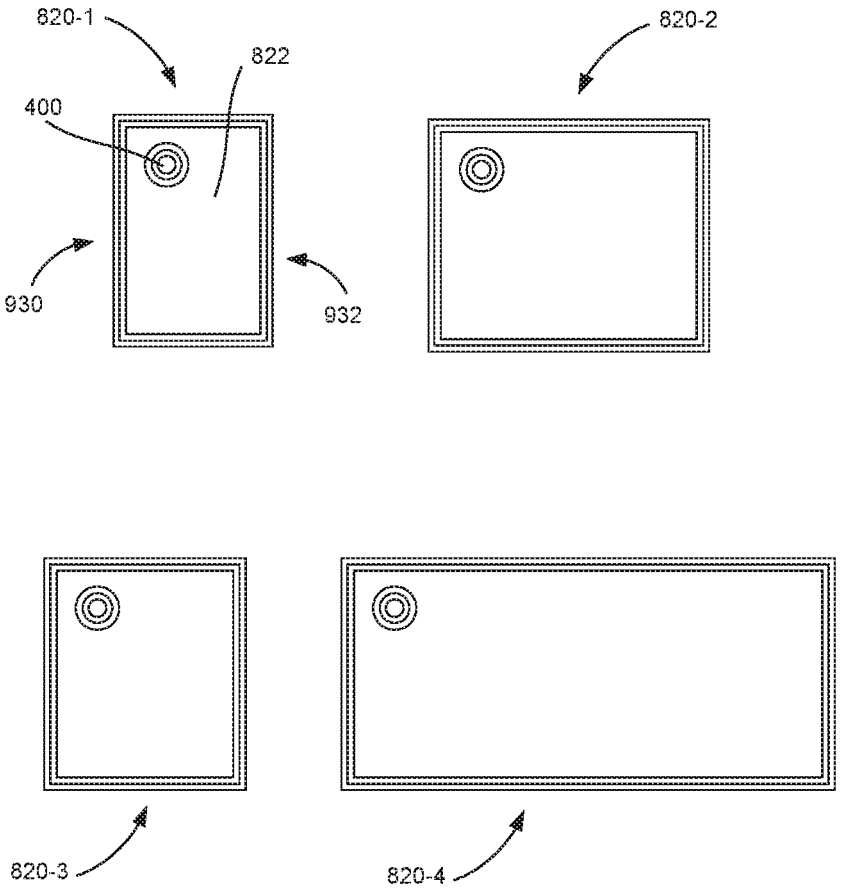
FIG. 9 is a plan view of a plurality of print liquid supply reservoirs with offset spouts according to an example of the principles described herein.

The reservoir (822) may be any size and may be defined by the amount of liquid which it can hold. For example, the reservoir (822) may hold at least 100 millimeters of fluid. While specific reference is made to a reservoir (822) holding a particular amount of fluid, the reservoir (822) may hold any volume of fluid. For example, as depicted in FIG. 9, different reservoirs (522) may hold 100, 250, 500, or 1,000 millimeters of fluid. As depicted in FIG. 8, in a generally empty state the reservoir (822) may have a rectangular shape. While FIG. 8 depicts the corners of the reservoir (822) as being right angles, in some examples the corners may be rounded. In some examples the corners may be chamfered.

To hold the fluid, the reservoir (822) may have any number of dimensions, for example, the reservoir may be at least 145 millimeters tall and in some particular examples may be between 145 millimeters and 160 millimeters tall when the reservoir (822) is empty. Note that in the figures, references to relative positions such as top, bottom, side and dimensions such as height and width are for reference in the figures and are not meant to be indications of limiting the present description.

The reservoir (822) may be a dual-layer reservoir (822). In any example presented herein, the reservoir (822) may include a pliable front face and a pliable back face (not shown) when empty. The two may be directly joined together using a staking process. The reservoir (822) material is a fluid/air/vapor barrier to inhibit air entry or vapor exit. Specifically, the reservoir (822) may be formed out of a plastic film, a metallic film, or combinations thereof to inhibit air/vapor transfer. To have such properties, the front face and/or the back face may be formed of multiple layers, each layer being formed of a different material and having a different property.

FIG. 8 also clear depicts the spout (400) affixed to the reservoir (822) through which the print liquid passes. Specifically, the spout (400) may be affixed at a corner of the front face at an offset (824) from a centerline of the front face (820). Specifically, the spout (400) may have an offset (824) at least 48 millimeters from the centerline of the reservoir (822). More specifically, the spout (400) may have an offset (824) of between 0 and 66 millimeters from a centerline of the reservoir (822).

In addition to having an offset (824) from a centerline of the reservoir (822), the spout (400) may have an offset from a top edge (826) of the reservoir (822) and may have an offset from a side edge (828) of the reservoir (822). Note that the directional indicators top, bottom, and side are used for explanatory purposes in the drawings and may change during operation. For example, the top edge (826) indicated in FIG. 8 may become the bottom edge as the reservoir (822) is inverted during use.

Returning to the offsets, the spout (400) may be offset between 15 and 50 millimeters from the top edge (826) of the reservoir (822) and in some examples may be offset between 25 and 35 millimeters from a top edge (826) of the reservoir (822). Similarly, the spout (400) may be offset between 15 and 50 millimeters from the side edge (828) of the reservoir (822) and in some examples may be offset between 25 and 35 millimeters from the side edge (828) of the reservoir (822).

FIG. 9 is a plan view of print liquid supplies (820-1, 820-2, 820-3, 820-4) having spouts (FIG. 4, 400) with angled flanges (FIG. 4, 408) according to an example of the principles described herein. As described above, each print liquid supply (820) includes a reservoir (822) that has a flat pliable body with a front face and a back face and that is formed of a liquid transfer-inhibiting material. Each liquid supply (820) also includes a spout (400) affixed to the reservoir (822). For simplicity in FIG. 8, the spout (400) and reservoir (822) for just one print liquid supply (820) are indicated with reference numbers.

Each reservoir (822) may include a first wall (930) which may be a wall closest to an insertion point of the reservoir (822) into a container. Each reservoir (822) also includes a second wall (932) which may be opposite the first wall (930) and which in some examples is a wall furthest from the insertion point of the reservoir (822) into the container. That is, when installed, the first wall (930) may be the wall of the reservoir (822) nearest the opening through which the reservoir (822) and its container were installed and the second wall (932) may be the wall of the reservoir (822) furthest from the opening through which the reservoir (822) is installed.

Figure 14:
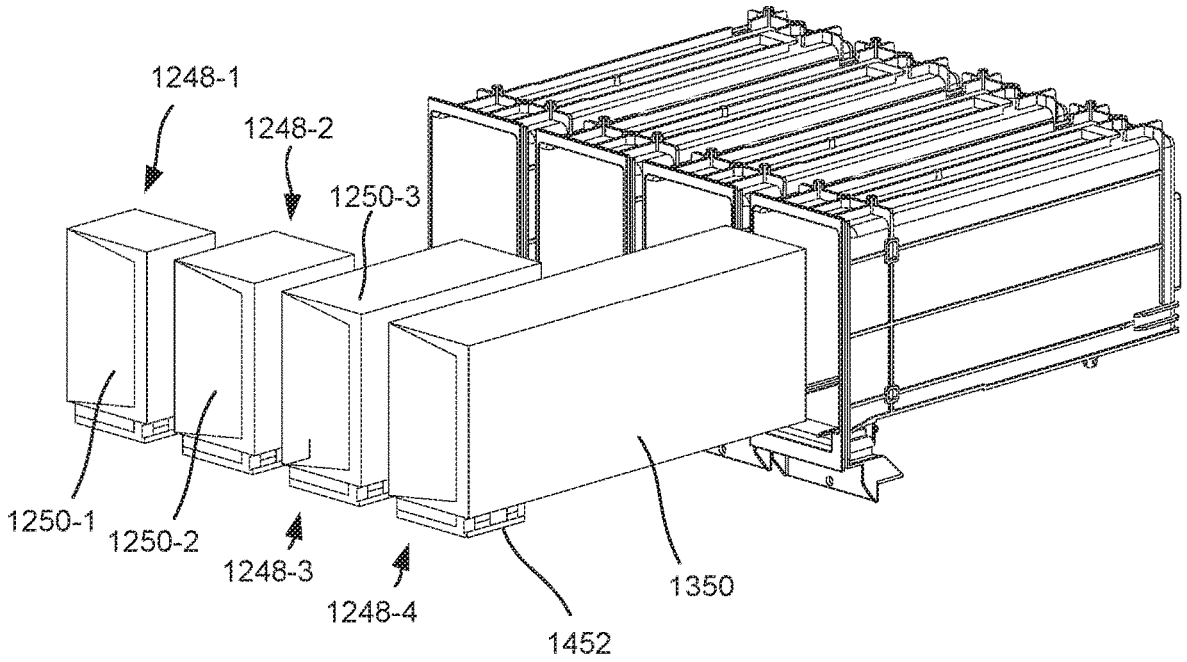
FIG. 14 is an isometric view of different bag-in-box print liquid supplies upon insertion into a printing device according to an example of the principles described herein.

As indicated in FIG. 9, for any size of reservoir (822) the spout (400) is located closer to the first wall (930) than the second wall (932). Moreover, in each case, regardless of the volume, the spout (400) is located the same distance away from the first wall (930). Put another way, each reservoir (822) may hold a different volume of fluid, such as 100 ml, 250, ml, 500, ml and/or 1,000 ml, and may have a different distance between the first wall (930) and the second wall (932). However, spouts (400) of the different reservoirs (822) are located at a same distance, i.e., have a same offset, from the corresponding first wall (930) as compared to other reservoirs (822). Put yet another way, the spouts (400) of the different reservoirs (822) may be the same distance away from the respective corners. Moreover, each reservoir (822) may have the same height. That is, each reservoir (822) may have a different width, i.e., difference between first wall (930) and second wall (932) but may have a height between 145 and 160 millimeters tall. As each reservoir (822) has the same height, the corresponding face of a container will similarly be the same. That is, as depicted in FIG. 14, regardless of the size or width of a reservoir (822) and/or container, the front face, or insertion face of the container has the same dimension regardless of the volume of the supply.

Figure 10:
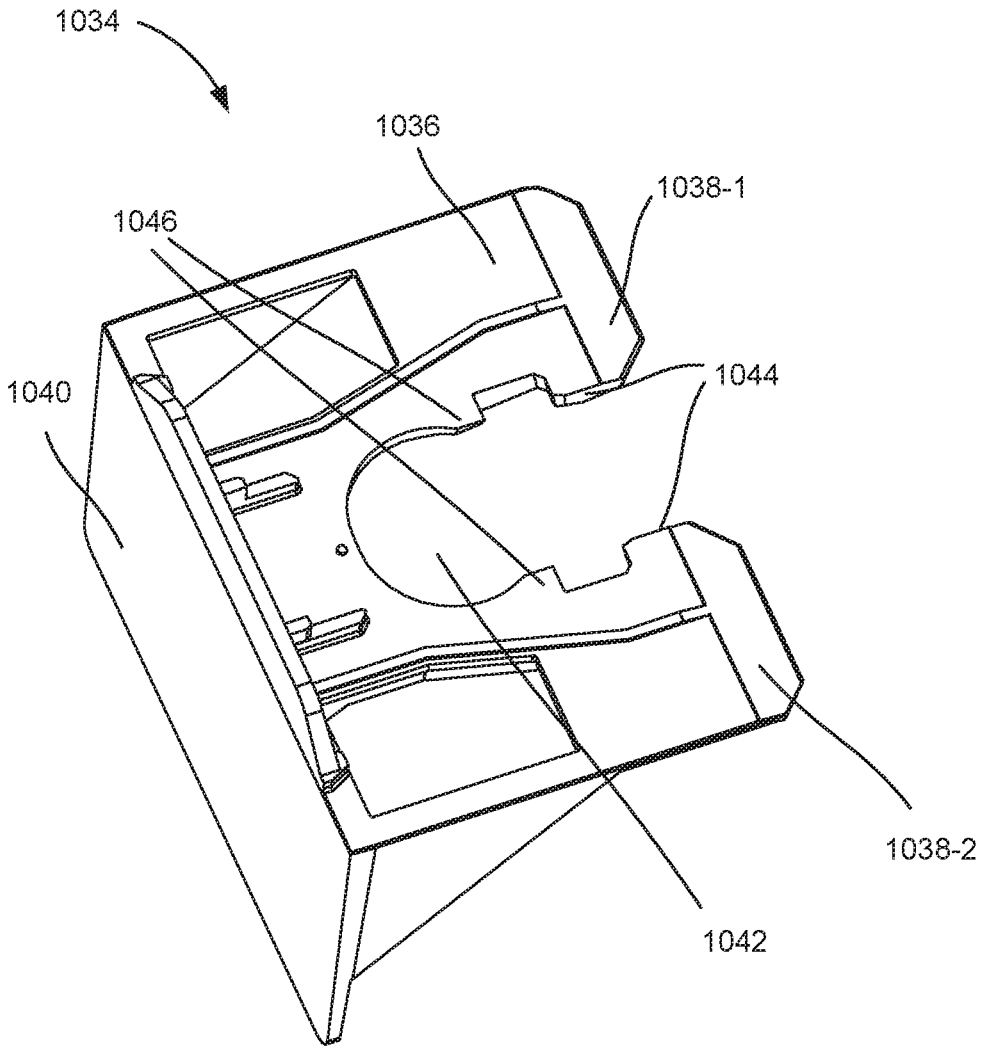
FIG. 10 is an isometric view of a supply container clamp plate with wedge-shaped fork ends according to an example of the principles described herein.
Figure 11:
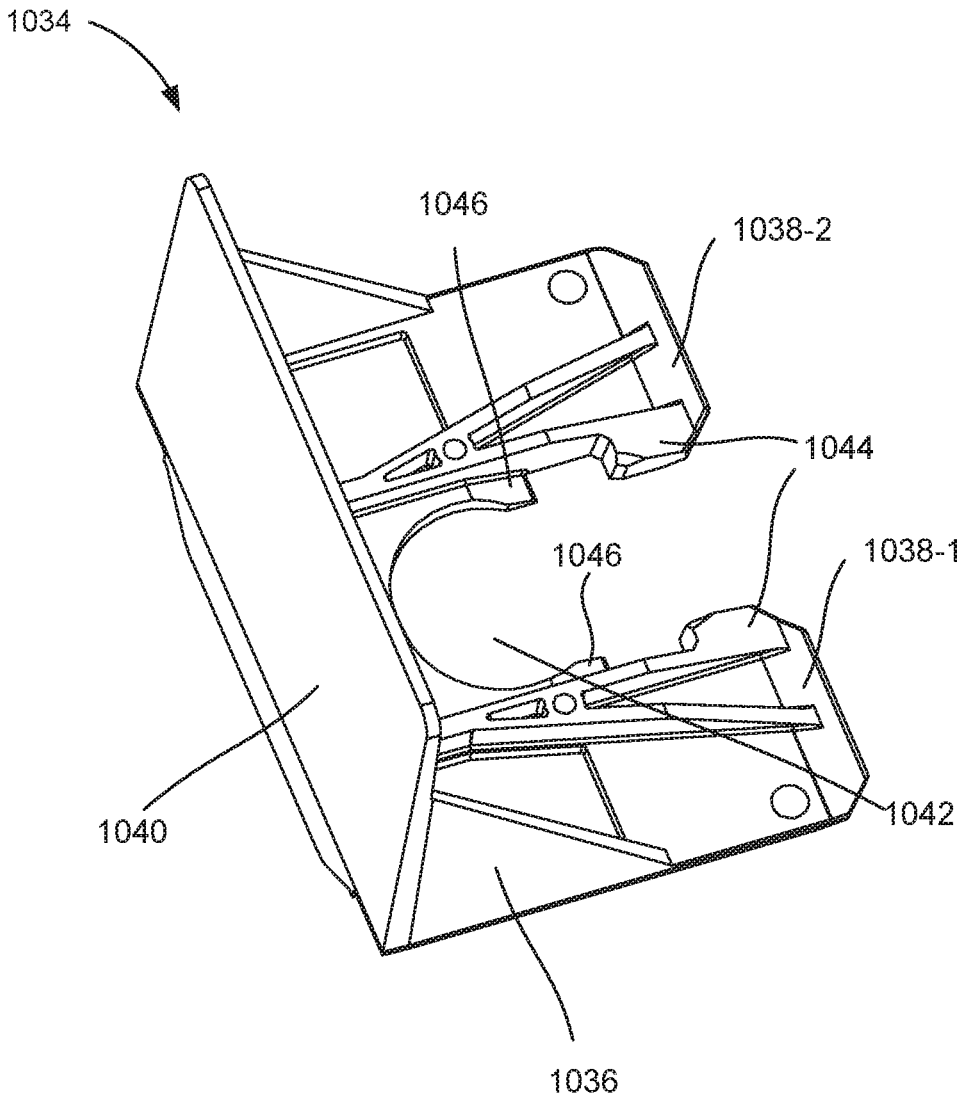
FIG. 11 is an isometric view of a supply container clamp plate with wedge-shaped fork ends according to an example of the principles described herein.

FIGS. 10 and 11 are isometric views of a supply container clamp plate assembly (1034) with wedge-shaped ends (1038-1, 1038-2), according to an example of the principles described herein. The clamp plate assembly (1034) includes a clamp plate (1036) that interfaces with the spout (FIG. 4, 400) as detailed in FIGS. 16A and 16B to secure the spout (FIG. 4, 400) and reservoir (FIG. 8, 822) firmly in a predetermined position such that the spout (FIG. 4, 400) can interface with a connection of the ejection device to deliver liquid to the ejection device. The clamp plate assembly (1034) also includes a back plate (1040) that is approximately orthogonal to the clamp plate (1036). Pushing the back plate (1040) engages the wedge-shaped forked ends (1038-1, 1038-2) of the clamp plate (1036) to engage the spout (FIG. 4, 400).

The clamp plate (1036) includes various components to facilitate such an interface with the spout (FIG. 4, 400). Specifically, the clamp plate (1036) includes a slot (1042) defined by two wedge-shaped forked ends (1038-1, 1038-2). The slot (1042) receives and retains the spout (FIG. 4, 100). That is the diameter of the slot (1042) may be the same, or slightly larger than the outside diameter of the sleeve (FIG. 4, 402) so as to create an interference fit between the clamp plate (1036) and the spout (FIG. 4, 400). In any example described herein, the diameters of the spout (FIG. 4, 400) relative to the slot (1042) may be varied to create a fit so as to secure the clamp plate to the spout.

The forked ends (1038-1, 1038-2) may be wedge-shaped. Accordingly, during insertion, the angle of the wedge interfaces with the angle of the angled clamp plate (FIG. 4, 408) to affix the container against the second flange (FIG. 4, 408). The pressure between the container and the second flange (FIG. 4, 408) prevents the relative motion of these components such that a rigid interface is provided. The rigid interface ensures that the spout (FIG. 4, 400) does not move as the container is inserted into a printing device nor during operation. If the spout (FIG. 4, 400) were to move, then there would be difficulty in aligning the spout (FIG. 4, 400) with a corresponding liquid interconnect on the printing device, and uncertainty regarding whether the spout (FIG. 4, 400) is properly aligned with such a liquid interconnect. Such uncertainty is unacceptable as it may lead to less than desired performance, a lack of functionality altogether and/or damage to components.

In some examples, the clamp plate (1036) includes a number of sets of protrusions (1044, 1046) that interface with the spout (FIG. 6, 400) and particularly the angled clamp flange (FIG. 6, 408) during the insertion process. Specifically, during a first stage of insertion, a set of leading protrusions (1044) that protrude in from a leading portion of the slot (1042) align below the angled clamp flange (FIG. 6, 408) and a set of trailing protrusions (1046) that protrude in from a trailing portion of the slot (1042) align above the angled clamp flange (FIG. 6, 408). In other words, the clamp plate assembly (1034) is angled downward respective to the spout (FIG. 6, 400). Doing so provides a large alignment point for the insertion of the container wall. When the container has been positioned between the second flange (FIG. 6, 406) and the angled clamp flange (FIG. 6, 408), the clamp plate assembly (1034) is rotated such that the leading protrusions (1044) pass through the notches (FIG. 6, 616) of the of the angled clamp flange (FIG. 6, 408) such that the leading protrusions (1044) and the trailing protrusions (1046) are above the angled clamp flange (FIG. 6, 408). In this position, the wedge-shaped ends (1038) are prepared to slide along the angled surface (FIG. 5, 510) of the angled clamp flange (FIG. 6, 408) to squish the container and spout (FIG. 4, 400) together. As described above, FIGS. 16A and 16B depict this operation.

The clamp plate depicted in FIGS. 10 and 11 may be formed of any material that does not deform in the face of the pressures exerted during insertion. For example, the clamp plate assembly (1034) may be formed out of a thermoplastic polyester material. In any of the examples described herein, the clamp plate assembly (1034) may be formed out of polyethylene terephthalate (PET).

Figure 12:
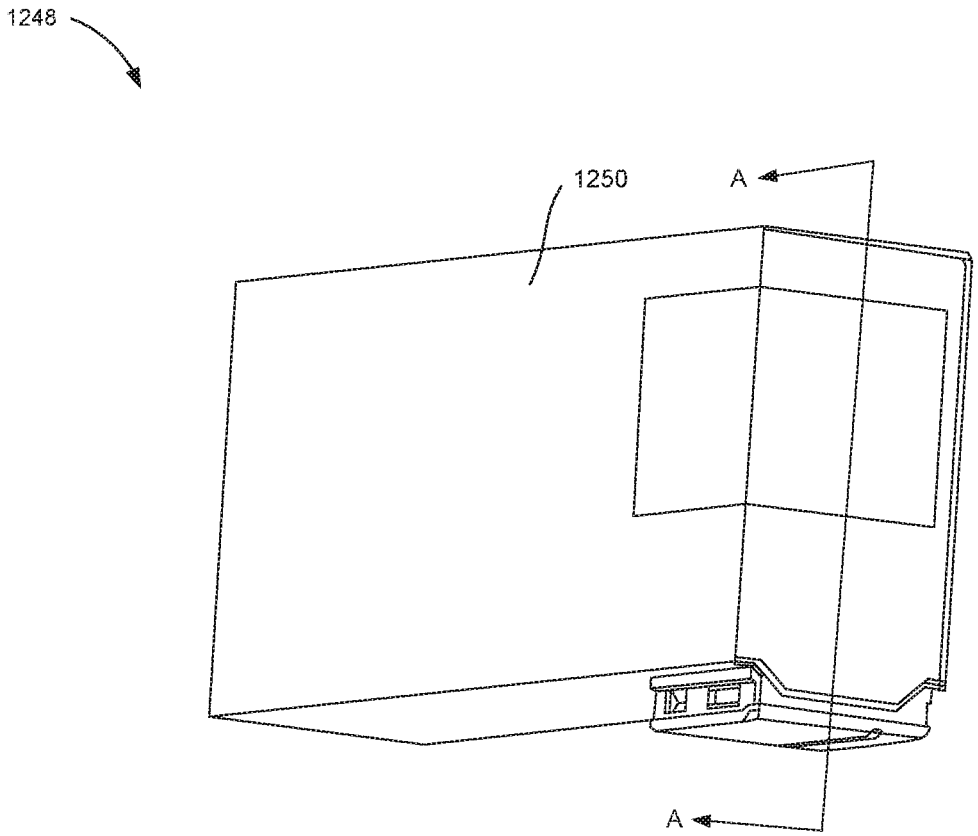
FIG. 12 is an isometric view of a bag-in-box print liquid supply according to an example of the principles described herein.

FIG. 12 is an isometric view of a bag-in-box print liquid supply (1248) according to an example of the principles described herein. As described above, the reservoir (FIG. 8, 822) may be disposed inside a container (1250). The container (1250) provides a rigid structure to be handled by a user during insertion. That is, while the reservoir (FIG. 8, 822) may be easy to manufacture it is difficult to handle and due to its conforming to the shape of the contents therein, may be difficult to insert into, and couple to an ejection device. The container (1250) described herein provides structural strength such that the reservoir (FIG. 8, 822) can be used. The container (1250) may be formed of any material including corrugated fiberboard, which may be referred to as cardboard. The corrugated fiberboard container (1250) may be easy to manufacture and may provide for effective manipulation by a user.

Figure 13:
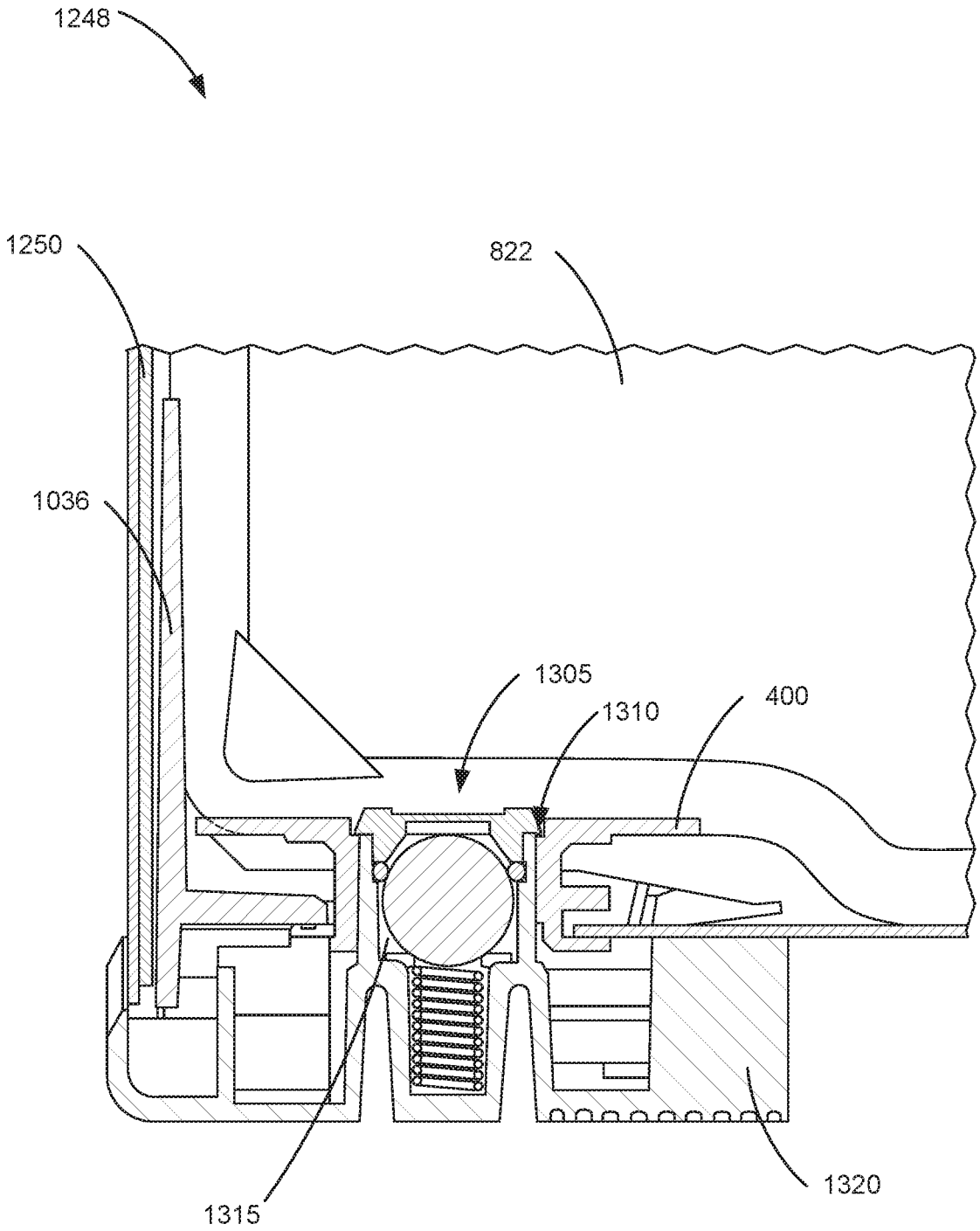
FIG. 13 is a cross-sectional view of a bag-in-box print liquid supply according to an example of the principles described herein.

FIG. 13 is a cross-sectional view of a bag-in-box print liquid supply (1348) according to an example of the principles described herein. Specifically, FIG. 13 is a cross-section taken along the line A-A from FIG. 12, As depicted in FIG. 13, the bag-in-box print liquid supply (1248) includes the pliable reservoir (822), the container (1250) in which the pliable reservoir (822) is disposed, the clamp plate (1036) as described above, and the spout (400) as described above.

The bag-in-box print liquid supply (1248), in any of the examples presented herein, includes a collar (1305). FIG. 13 also shows a lip (1310) formed on the collar (1305). The lip (1310) extends past an exterior circumference of a fluidic channel (1315) formed in a fluidic interface (1320).

FIG. 14 is an isometric view of different bag-in-box print liquid supplies (FIG. 12, 1248-1, 1248-2, 1248-3, 1248-4) upon insertion into a printing device, according to an example of the principles described herein. As described herein, the print liquid supplies (FIG. 12, 1248) provide the print liquid to a printing device or other ejection device. Accordingly, in some examples, a printing device or other ejection device includes ports to receive the print liquid supplies (1248). The slots may have a uniform size opening. Accordingly, the dimension of each print liquid supply container (1250-1, 1250-2, 1250-3, 1250-4), regardless of the volume, may have a size to fit in the opening. That is, each container (1250) depicted in FIG. 14 has a different volume on account of them having different lengths. However, the dimensions of each container (1250) that align with the opening in the port is the same. In some example, the front surface, i.e., the surface exposed to a user, may have an aspect ratio of at least 1.5. As a specific example, each container (1250) face may have an aspect ratio of between 1.5 and 2.0. That is, the height of the container (1250) may be 1.5 to 2 times greater than the width of the container (1250). In any of the examples presented herein, each container (1250) may have an aspect ratio of 1 or less. By having the container (1250) with the same front surface shape and size, regardless of a length, and therefore volume, a variety of volumes of print supplies can be used in a given supply port. That is, rather than being limited to a size of a print supply, a port can accept a variety of containers (1250) having different volumes, each with the same front surface size and shape.

FIG. 14 also depicts the location of the spouts (FIG. 4, 400). That is, the spouts (FIG. 4, 400) may be disposed under the fluidic interface (1452) depicted in FIG. 14. In some examples described herein, the fluidic interfaces (1452) may also be referred to as a liquid bag interface. Accordingly, as depicted in FIG. 14, the spouts (FIG. 4, 400) may be disposed at a corner of the reservoir (FIG. 8, 822), such that upon insertion of reservoir (FIG. 8, 822) into the container (1250), the spout (FIG. 4, 400) is at a corner of the container (1250) that is to be adjacent an opening of the port. Still further, the spout (FIG. 4, 400) may be disposed at a corner of the reservoir (FIG. 8, 822) such that upon insertion of the reservoir (FIG. 8, 822) into the container (1250), the spout is at a corner of the container (1250) that is to be adjacent to a bottom of the port. Doing so facilitates liquid flow out of the reservoir (FIG. 8, 822) as gravity will naturally draw the liquid down and out.

Figure 15:
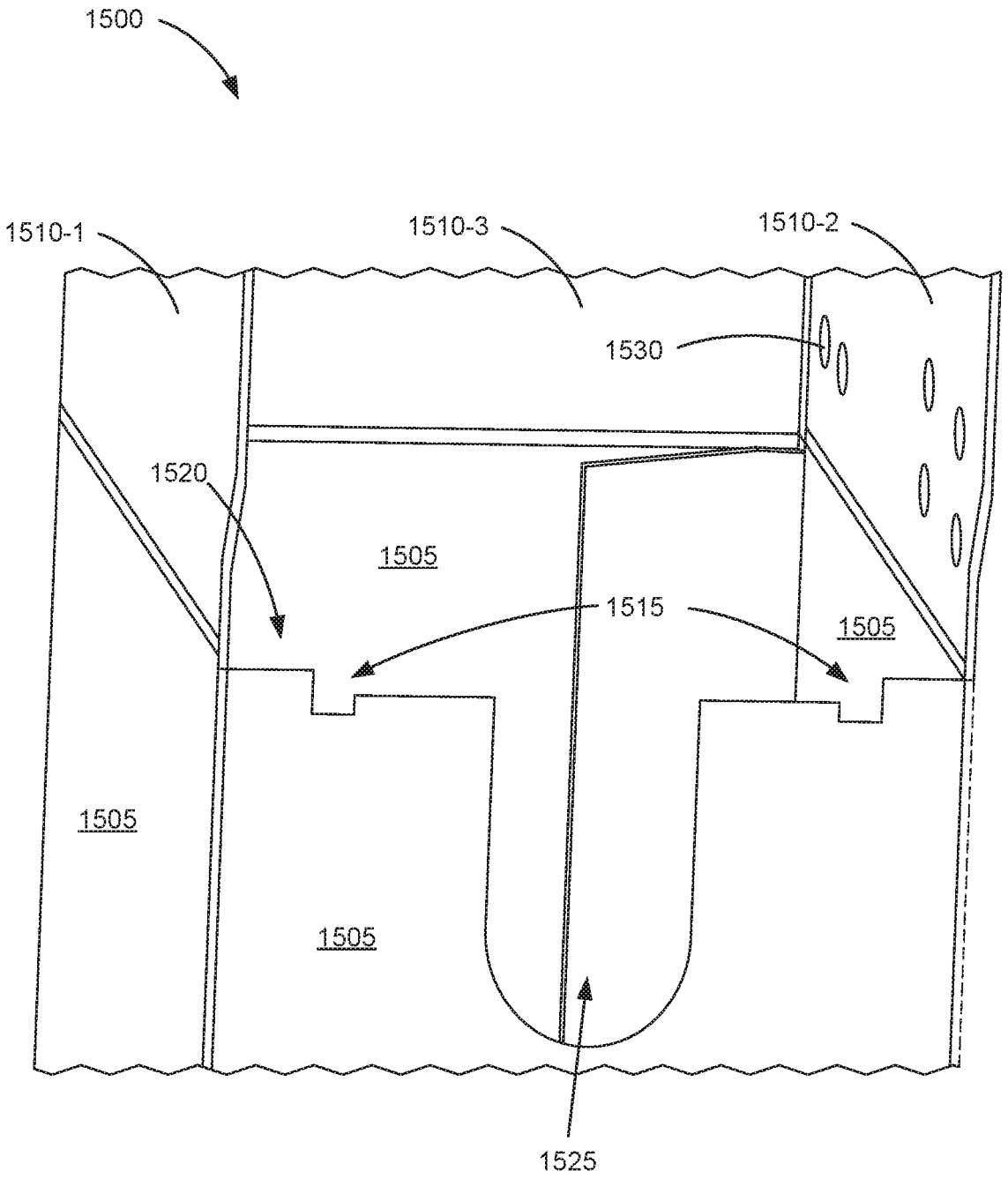
FIG. 15 is an isometric view of an opening of a bag-in-box print supply according to an example of the principles described herein.

FIG. 15 is an isometric view of an opening of a bag-in-box print liquid supply (1500), according to an example of the principles described herein. As described herein, the bag-in-box print liquid supply (1500) may include a number of walls (1505) formed into a cuboid shape. In any example described herein, one of the walls (1505) of the cuboid shape may be formed by a number of flaps (1510-1, 1510-2, 1510-3), each of which when folded against each other form a wall (1505). In this example, the flaps (1510-1, 1510-2, 1510-3) may serve as an entry location for a pliable bag to be inserted into the bag-in-box print liquid supply (1500) during assembly of the bag-in-box print liquid supply (1500).

The bag-in-box print liquid supply (1500) may further include a number of alignment structures (1515) used to align a support element with the walls (1505) of the bag-in-box print liquid supply (1500). In an example, the support element includes the clamp plate (FIG. 10, 1036) described herein. In these examples, features formed on the clamp plate (FIG. 10, 1036) may fit within the alignment structures (1515) such that the clamp plate (FIG. 10, 1036) may fit therein and lie flush against the edge (1520) of the wall at which the alignment structures (1515) are cut into.

The bag-in-box print liquid supply (1500), in an example, includes a channel (1525) through which the spout (FIG. 4, 400) of the reservoir (FIG. 8, 822) may be placed along with the clamp plate (FIG. 10, 1036). In an example, the clamp plate (FIG. 10, 1036) may include a number of elongated alignment fingers formed thereon to interface with edges of the channel (1525) creating a fit between the clamp plate (FIG. 10, 1036) and a wall (1505) of the bag-in-box print liquid supply (1500).

In any example described herein, any number of flaps (1510-1, 1510-2, 1510-3) may include a number of holes (1530) or voids formed therein. The holes (1530) may be used to maintain an amount of adhesive material therein as the liquid impermeable liquid bag (310) is being closed. In an example, the adhesive material may be used to adhere one of the flaps (1510-1, 1510-2, 1510-3) to another as well as adhere a number of the flaps (1510-1, 1510-2, 1510-3) to the back plate (FIG. 10, 1040) of the clamp plate (FIG. 10, 1036), Once the adhesive material has cured, the bag-in-box print liquid supply (1500) may remain closed housing the pliable bag inside full of fluid.

FIGS. 16A and 16B illustrate a cross-sectional view and isometric view, respectively of the assembly of a print liquid supply according to an example of the principles described herein. As described herein, the print liquid supply includes many components such as a reservoir (822), a spout (400), and a clamp plate assembly (1034) that are all, at least partially disposed within a container (1250). The system also includes a fluidic interface (1452) that provides an interface between the printing device in which the supply is inserted. As depicted in FIGS. 16A and 16B, the spout (400) has been attached to the reservoir (822) via a staking or other operation such that the first flange (404) is disposed on an inside of the reservoir (822). FIG. 16A also clearly depicts the angle of the wedge-shaped forked ends (1038). In some examples, the angle of these wedge-shaped ends (1038) matches an angle of the angled surface (FIG. 5, 510) of the angled clamp flange (408).

As depicted in FIG. 16A, the clamp plate assembly (1034) is aligned at an angle relative to the spout (400). Specifically, they are aligned such that as the clamp plate assembly (1034) is slid forward in a direction indicated by the arrow (1654) leading protrusions (FIG. 10, 1044) on the clamp plate assembly (1034) are aligned below the angled clamp flange (408) and the trailing protrusions (FIG. 10, 1046) on the clamp plate assembly (1034) are aligned above the angled clamp flange (408). Doing so creates a large window in which the container (1250) can be inserted, Put another way, during a first stage of insertion of the clamp plate assembly (1034), the straight surface (FIG. 5, 512) of the angled clamp flange (408) interfaces with the leading protrusions (FIG. 10, 1044) on the clamp plate (1036) to maintain the clamp plate assembly (1034) at a non-parallel angle relative to the angled clamp flange (408). The clamp plate assembly (1034) will remain in this angled orientation until the leading protrusions (FIG. 10, 1044) align with the notches (FIG. 6, 616) in the angled clamp flange (408).

FIG. 16B also depicts the alignment mechanism on the container (1250). The alignment mechanism on the container (1250) positions the spout (400) at a predetermined location during the insertion of the pliable reservoir (822). Such a predetermined location may be near an opening of a port in which the bag-in-box print liquid supply is received. Putting the spout (400) at the front of the port allows for liquid supplies with different lengths to be inserted into the port easily by a user. For example, were the spout (400) near the back of a port, a user would have to extend their hand fully inside the port to insert a smaller liquid supply. As indicated in FIG. 16A the alignment mechanism is a channel (1656-3) that receives the spout (400) and slots (1656-1, 1656-2) to receive alignment protrusions (1658-1, 1658-2) of the clamp plate assembly (1034).

FIG. 16B illustrates the closure of the bag-in-box print liquid supply. Specifically, in some examples, the container (1250) includes a foldable opening through which the pliable reservoir (822) is inserted. Accordingly, once the spout (400), clamp plate assembly (1034), and reservoir (822) are fully inserted and properly aligned with the container (1250), the foldable opening may be closed and sealed. In this example, upon closing the first flange (FIG. 4, 404) and angled clamp flange (FIG. 4, 408) as well as the clamp plate assembly (1034) are enclosed within the container (1250).

Figure 17:
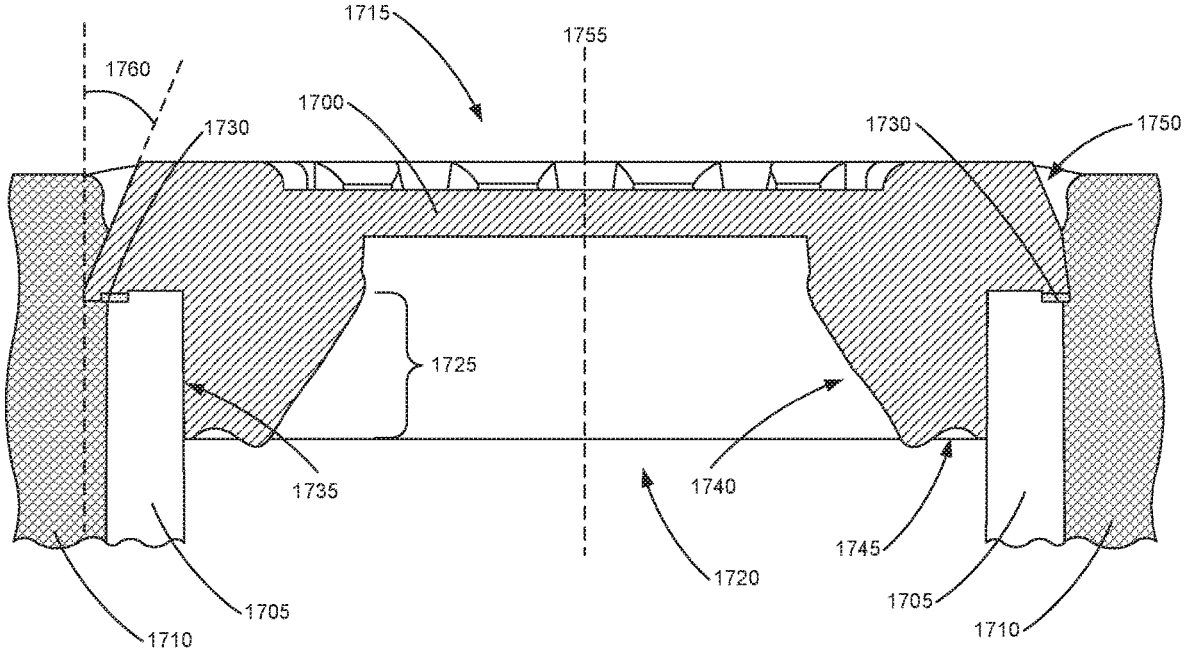
FIG. 17 is a side cut-out view of a collar according to an example of the principles described herein.

FIG. 17 is a side cut-out view of a collar (1700) according to an example of the principles described herein, FIG. 17 shows the collar (1700) is shown coupled to a fluidic channel (1705). In any of the examples presented herein, the fluidic channel (1705) may be formed within a fluidic interface as described herein. The fluidic channel (1705) and collar (1700), being coupled together, may be press fitted into a spout (1710) of a pliable fluidic container.

The collar (1700) includes a first surface (1715) and a second surface (1720). The first surface (1715) may be the surface that is exposed to an interior of the pliable fluidic container where a fluid is maintained. The second surface (1720) may be the surface that is exposed to an interior of the fluidic channel (1705).

The collar (1700) may, at the second surface (1720) include a barrel (1725). The barrel (1725) may have an exterior surface (1735). The exterior surface (1735) contacts an interior surface of the fluidic channel (1705) and prevents the translation of the collar (1305) horizontally relative to the fluidic channel (1705) as shown in FIG. 17. The collar (1700) further includes an interior surface (1740). In any of the examples presented herein, the interior surface (1740) of the second surface (1720) of the collar (1700) may include a gasket interface (1745). The gasket interface (1745) may, in any of the examples presented herein, interface with a gasket used within the fluidic channel (1705). In this example, the gasket may interface with a valve ball that prevents backflow into the pliable fluidic container. In an example, however, the collar (1305) may not include a gasket interface (1745) and instead may have the interior surface (1740) of the collar (1700) interface with the ball described. In an example, the collar (1700) may not interface with a ball.

In any of the examples presented herein, the collar (1305) may include a flash trap (1730). The flash trap (1730) may be used during a welding process as a location where melted portions of the collar (1700) and/or fluidic channel (1705) may be maintained. Again, the collar (1700) may be laser welded to the fluidic channel (1705). During the laser welding process, some portion of the collar (1700) and/or first end of the fluidic channel (1705) may be melted. These melted portions may flow out of the interface between the collar (1700) and the fluidic channel (1705). If left, the melted portions of the collar (1700) and/or fluidic channel (1705) may subsequently harden so as to create bulges and/or sharp protrusions out of the collar (1700)/fluidic channel (1705) subassembly. The bulges and/or sharp protrusions may damage the interior surface of the spout (1710) leading to an incomplete fluid barrier (100). To prevent the formation of the bulges and/or sharp protrusions, the collar (1700) may include the flash trap (1730) formed between the collar (1700) and the fluidic channel (1705). The flash trap (1730) may receive an amount of the melted material from the collar (1700) and/or fluidic channel (1705) therein during the laser beam welding process.

The first surface (1715) may include a tapered surface (1750). The tapered surface (1750) may have an angle (1760) of between 18-25 degrees relative to an axis (1755) of the collar (1700). During the laser welding process of the collar (1700) to the fluidic channel (1705), the angle (1760) of the tapered surface (1750) may refract the laser light through the transparent or semi-transparent material of the collar (1700) so as to direct the laser light to the interface between the collar (1700) and the fluidic channel (1705). The laser light then melts an amount of material of either or both of the collar (1700) and fluidic channel (1705). The melted amount of material from either or both of the collar (1700) and fluidic channel (1705) may leak into the flash trap (1730) and be allowed to solidify. The flash trap (1730) thereby prevents an amount of melted material from leaking beyond the diameters of either the collar (1700) and/or fluidic channel (1705). The laser welding process may melt a layer of either or both of the collar (1700) and fluidic channel (1705) that is between 10-200 microns thick. In an example, the flash trap (1730) may have a volume of between 0.5 $mm^3$ and 2 $mm^3$. In an example, the flash trap (1730) may have a volume of 1.38 $mm^3$.

Figure 18:
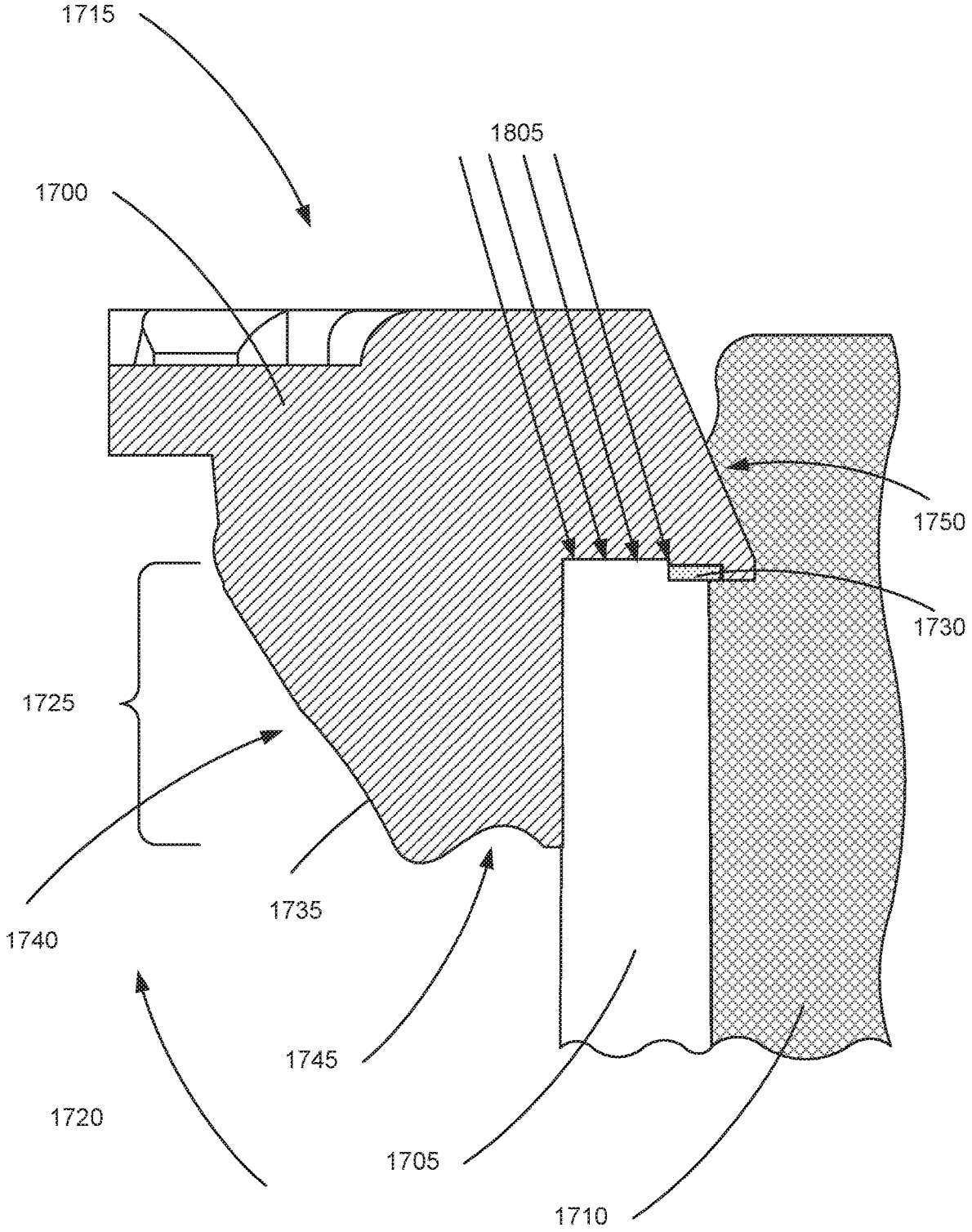
FIG. 18 is a side cut-out view of the collar of FIG. 17 according to an example of the principles described herein.

FIG. 18 is a side cut-out view of the collar of FIG. 17 according to an example of the principles described herein. During a laser welding process, laser light (1805) may be directed to the interface between the collar (1700) and fluidic channel (1705). The laser light (1805) may have a particular intensity and direction to melt the material of either or both the collar (1700) and fluidic channel (1705) as described herein. The melted material is allowed to flow into the flash trap (1730) as described herein.

The specification and figures describe a fluid barrier, a printing fluid supply, and a bag-in-box printing fluid supply that includes a collar placed between a collapsible fluid bag and a fluidic channel of a fluidic interface. The collar may prevent the disassembly and/or translation of the collar/fluidic channel subassembly from the spout. The material used to form the collar may, during assembly, prevent damage of the interior surface of the spout. The collar coupled to the fluidic channel also creates and completes the fluidic barrier characteristics of the collapsible fluid bag. This prevents fluid from exiting and entering into the fluid maintained in the collapsible fluid bag.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluid barrier, comprising:

a collar coupled to a first end of a fluidic channel of a fluidic interface;

the collar comprising a lip to prevent separation of the fluidic channel from a pliable fluidic container.

2. The fluid barrier of claim 1, wherein the collar is coupled to the first end of the fluidic channel via laser beam welding.

3. The fluidic barrier according to claim 1, wherein the collar further comprises a flash trap formed between the collar and the first end of the fluidic channel to receive an amount of melted weld material therein during a laser beam welding process.

4. The fluidic barrier according to 1, the collar comprising a second surface, the second surface interfacing with a first surface of the fluidic channel.

5. The fluidic barrier of claim 4, wherein the second surface comprises a barrel extending from the second surface, an exterior surface of the barrel interfacing with an interior surface of the fluidic channel.

6. The fluidic barrier according to claim 4, wherein the second surface comprises a dipped surface to receive a gasket.

7. The fluidic barrier according to claim 1, the collar comprising a first surface, the first surface comprising a radially tapered surface tapered from the first surface of the collar toward the first end of the fluidic channel.

8. The fluidic barrier of claim 7, wherein the angle of the radially tapered surface is 18-25 degrees relative to an axis of the collar.

9. The fluidic barrier according to claim 1, wherein the collar further comprises at least one structurally supporting spoke formed between interior surfaces of the collar.

10. The fluidic barrier according to claim 1, wherein the collar comprises an annularly concave portion to receive a gasket interior to the fluidic channel.

11. A printing fluid supply, comprising:

an at least partially collapsible fluid bag;

a substantially rigid fluidic interface having a fluidic channel fluidically coupled to the fluid bag; and a collar coupled to the fluidic channel forming a fluid barrier between the fluid bag and the fluidic interface.

12. The printing fluid supply of claim 11, wherein the fluidic interface includes a needle receiving liquid channel portion with a liquid interface to interface with a receiving station needle and a bag connecting liquid channel portion that extends at an angle with the needle receiving liquid channel portion, wherein the bag connecting liquid channel portion projects from the fluidic interface to connect to the bag inside a support container that holds the bag.

13. The printing fluid supply according to claim 11, wherein the collar mechanically couples the fluidic interface to the fluid bag.

14. The printing fluid supply according to claim 11, wherein the collar is more fluid permeable relative to the fluid bag.

15. The printing fluid supply according to claim 11, wherein the collar is more fluid permeable relative to the fluidic interface.

16. The printing fluid supply according to claim 11, wherein the collar further comprises a flash trap formed between the collar and a first end of the fluidic channel to receive an amount of melted weld material therein during a laser beam welding process welding the collar to the fluidic channel.

17. The printing fluid supply according to claim 11, further comprising a first surface of the collar comprising a radially tapered surface tapered from the first surface of the collar toward a second surface of the collar opposite the first surface of the collar.

18. A bag-in-box printing fluid supply, comprising:

a pliable fluid containment bag to hold a supply of printing fluid;

a carton in which the pliable fluid containment bag is disposed;

a fluidic channel formed in a fluidic interface fluidically coupled to the pliable fluid containment bag; and a collar coupled to an end of the fluidic channel, the fluidic channel and collar placed within a spout of the pliable fluid containment bag.

19. The bag-in-box printing fluid supply of claim 18, wherein the spout comprises at least one rib formed on an interior surface of the spout and wherein the ribs provide an interference fit with a portion of the fluidic channel.

20. The bag-in-box printing fluid supply according to claim 18, wherein the collar comprises a first surface, the collar comprising a radially tapered surface tapered from the first surface of the collar toward a second surface of the collar opposite the first surface of the collar.

21. The bag-in-box printing fluid supply according to claim 20, wherein the radially tapered surface prevents damage to the ribs of the fluidic channel during an insertion process of the collar and fluidic channel into the spout of the pliable fluid containment bag.

22. The bag-in-box printing fluid supply according to claim 18, wherein the fluidic channel comprises a plurality of fluidic channels each having their own distinct longitudinal axis.

* * * * *